US009208744B2

(12) United States Patent
Fukunaga et al.

(10) Patent No.: US 9,208,744 B2
(45) Date of Patent: Dec. 8, 2015

(54) DISPLAY DEVICE AND ELECTRONIC APPARATUS

(71) Applicant: Japan Display Inc., Tokyo (JP)

(72) Inventors: Yoko Fukunaga, Tokyo (JP); Masaya Tamaki, Tokyo (JP); Takayuki Nakanishi, Tokyo (JP); Yasuyuki Teranishi, Tokyo (JP)

(73) Assignee: JAPAN DISPLAY INC., Tokyo (JP)

( * ) Notice: Subject to any disclaimer, the term of this patent is extended or adjusted under 35 U.S.C. 154(b) by 72 days.

(21) Appl. No.: 14/039,347

(22) Filed: Sep. 27, 2013

(65) Prior Publication Data

US 2014/0092080 A1 Apr. 3, 2014

(30) Foreign Application Priority Data

Sep. 28, 2012 (JP) ..... 2012-218633

(51) Int. Cl.
*G09G 3/34* (2006.01)
*G09G 3/36* (2006.01)

(52) U.S. Cl.
CPC ..... *G09G 3/3696* (2013.01); *G09G 3/3406* (2013.01); *G09G 2300/0456* (2013.01); *G09G 2320/0247* (2013.01)

(58) Field of Classification Search
CPC ..... G09G 3/3696; G09G 3/3406; G09G 2320/0247; G09G 2300/0456
USPC ..... 345/87, 212
See application file for complete search history.

(56) References Cited

U.S. PATENT DOCUMENTS

| | | | | |
|---|---|---|---|---|
| 5,684,551 | A | 11/1997 | Nakamura et al. | |
| 5,847,789 | A | 12/1998 | Nakamura et al. | |
| 2003/0112213 | A1 | 6/2003 | Noguchi et al. | |
| 2005/0068279 | A1 | 3/2005 | Hirota et al. | |
| 2005/0270433 | A1 * | 12/2005 | Ohue et al. | 349/38 |
| 2007/0153171 | A1 * | 7/2007 | Kim | 349/114 |
| 2012/0086898 | A1 * | 4/2012 | Tanaka | 349/123 |

FOREIGN PATENT DOCUMENTS

| | | |
|---|---|---|
| JP | 2771392 | 7/1998 |
| JP | 2003-315766 | 11/2003 |

(Continued)

OTHER PUBLICATIONS

Notice of Rejection issued in connection with Japanese Patent Application No. 2012-218633, dated Oct. 21, 2014. (3 pages).

(Continued)

*Primary Examiner* — Sahlu Okebato
(74) *Attorney, Agent, or Firm* — K&L Gates LLP

(57) ABSTRACT

According to an aspect, a display device includes a liquid crystal layer, a transparent electrode, a reflective electrode, a drive circuit, and a controller. The controller is configured to switch a mode between a first mode for driving the drive circuit at a liquid-crystal inversion frequency of a first frequency so that screen display using light reflected by the reflective electrode is performed and a second mode for driving the drive circuit at a liquid-crystal inversion frequency of a second frequency higher than the first frequency so that screen display using light passing through the opening of the reflective electrode is performed.

16 Claims, 16 Drawing Sheets

(56) References Cited

FOREIGN PATENT DOCUMENTS

| | | |
|---|---|---|
| JP | 2004-078249 | 3/2004 |
| JP | 2004-177875 | 6/2004 |
| JP | 2005-122110 | 5/2005 |
| JP | 2007-121368 | 5/2007 |
| JP | 2009-093115 | 4/2009 |
| TW | 200401254 | 1/2004 |

OTHER PUBLICATIONS

Office Action issued in connection with Taiwanese Patent Application No. 102132656, dated Aug. 19, 2015, 2014. (9 pages).

* cited by examiner

DISPLAY DEVICE AND ELECTRONIC APPARATUS

CROSS REFERENCES TO RELATED APPLICATIONS

The present application claims priority to Japanese Priority Patent Application JP 2012-218633 filed in the Japan Patent Office on Sep. 28, 2012, the entire content of which is hereby incorporated by reference.

BACKGROUND

1. Technical Field

The present disclosure relates to a transflective display device including a reflective section and a transmissive section. The present disclosure further relates to an electronic apparatus including the display device.

2. Description of the Related Art

In recent years, the demand for display devices for a mobile apparatus, such as a mobile phone and an electronic paper, has been increasing. Regarding the display devices for a mobile apparatus, reflective display devices have been attracting attention in terms of the visibility under external light and low power consumption (refer to Japanese Patent No. 2771392, for example). There have also been developed display devices that achieve both the visibility under external light and the visibility in a dark place, including transflective display devices combining characteristics of a transmissive display device and a reflective display device. The transflective display devices, for example, include a transmissive display area (a transmissive display section) and a reflective display area (a reflective display section) in one pixel (refer to Japanese Patent Application Laid-open Publication No. 2009-93115 (JP-A-2009-93115), for example). The liquid crystal display device disclosed in JP-A-2009-93115 has difference in level at a boundary between the transmissive display area and the reflective display area. The thickness of a liquid crystal layer of the transmissive display area is made approximately twice that of the reflective display area. This configuration makes the phase differences equal to each other between light passing through the liquid crystal layer once in transmission and light passing through the liquid crystal layer twice in reflection.

Display devices for a mobile apparatus are desired to further reduce the power consumption while ensuring the visibility under external light. In transmissive display devices, a backlight consumes more than half of the power. By contrast, transflective display devices have excellent external light visibility under sunlight. The transflective display device disclosed in JP-A-2009-93115 makes the thickness of the liquid crystal layer of the transmissive display area approximately twice the thickness of the liquid crystal layer of the reflective display area. This configuration generates no reflection in a transmissive opening and the boundary between the transmissive display area and the reflective display area, thereby reducing the aperture ratio in the reflective display area. As a result, display performed simply by reflective display renders a screen darker in an environment such as a room, making it necessary to perform transmissive display by turning on the backlight. Thus, the transflective display device fails to fully enjoy the low power consumption in reflective display.

To reduce driving electric power, the transflective display device may drive at low speed at an inversion frequency of lower than 30 Hz (equivalent to a frame rate of 60 fps), for example. However, drive at low speed at an inversion frequency of lower than 30 Hz (equivalent to a frame rate of 60 fps) causes a flicker, thereby providing a user with a sense of discomfort. For this reason, the drive at low speed cannot be employed.

For the foregoing reasons, there is a need for a display device that can reduce the power consumption while reducing a flicker, and an electronic apparatus including the display device.

SUMMARY

According to an aspect, a display device includes a liquid crystal layer, a transparent electrode, a reflective electrode, a drive circuit, and a controller. The transparent electrode is arranged on a side of the liquid crystal layer on which ambient light is incident. The reflective electrode is arranged on a side of the liquid crystal layer opposite to the transparent electrode and reflects light reaching from the liquid crystal layer. The reflective electrode is divided into a plurality of pixel electrodes formed for each pixel. Each pixel is formed of one of the pixel electrodes, the transparent electrode, and the liquid crystal layer interposed therebetween. The reflective electrode has a plurality of openings formed around the respective pixel electrodes. The drive circuit controls a voltage applied to the pixel electrode and the transparent electrode to drive each pixel. The controller controls an operation of the drive circuit. The pixel is configured to display black when a same potential is applied between the pixel electrode and the transparent electrode and display white when a predetermined voltage difference is applied between the pixel electrode and the transparent electrode. The drive circuit is configured to perform switching in accordance with a video signal such that a voltage for displaying white or black is applied between the pixel electrode and the transparent electrode. The controller is configured to switch a mode between a first mode for driving the drive circuit at a liquid-crystal inversion frequency of a first frequency so that screen display using light reflected by the reflective electrode is performed and a second mode for driving the drive circuit at a liquid-crystal inversion frequency of a second frequency higher than the first frequency so that screen display using light passing through the opening of the reflective electrode is performed.

According to another aspect, an electronic apparatus includes the display device and a control device that supplies the video signal to the display device.

Additional features and advantages are described herein, and will be apparent from the following Detailed Description and the figures.

DETAILED DESCRIPTION

Exemplary embodiments according to the present disclosure are described below in detail with reference to the accompanying drawings. The explanation will be made in the following order:

1. Embodiment (Display Device)

A display device capable of switching liquid-crystal inversion frequency depending on drive mode, area coverage modulation, normally black mode, low liquid-crystal inversion frequency; and 2. Example of Application (Electronic Apparatus)

An example in which the display device according to the embodiment is applied to an electronic apparatus.

1. Embodiment

A display device according to the present embodiment is applicable to flat-panel (flat) display devices including a reflective electrode, a shutter provided to each pixel, and a backlight. Examples of the flat-panel display devices include, but are not limited to, display devices provided with liquid crystal display (LCD) panels and display devices provided with micro electro mechanical systems (MEMS).

The display device according to the present embodiment is applicable to both display devices supporting monochrome display and display devices supporting color display. If the display device is applied to display devices supporting color display, one pixel (unit pixel) serving as a unit of a color image is composed of a plurality of sub-pixels (sub-pixel). More specifically, one pixel is composed of three sub-pixels of a sub-pixel that displays red (R), a sub-pixel that displays green (G), and a sub-pixel that displays blue (B), for example, in the display devices supporting color display.

Each pixel is not necessarily composed of sub-pixels of the three primary colors of RGB and may be obtained by further adding a sub-pixel of one color or sub-pixels of a plurality of colors to the sub-pixels of the three primary colors of RGB. More specifically, for example, each pixel may be obtained by adding a sub-pixel that displays white (W) to increase the luminance or adding at least one sub-pixel that displays a complementary color to expand a color reproduction range. The following describes the case where the display device is a display device supporting color display (a display device in which three sub-pixels correspond to one pixel).

1-1. Configuration

Figure 1:
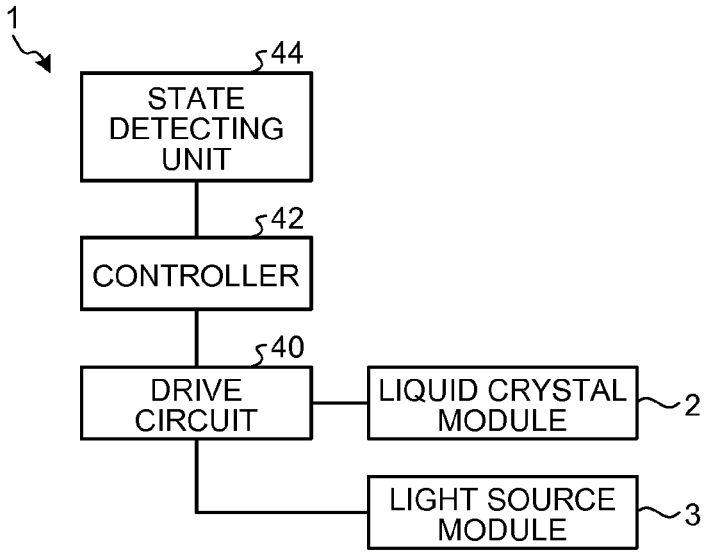
FIG. 1 is a block diagram of an example of a configuration of a display device according to an embodiment of the present disclosure.
Figure 2:
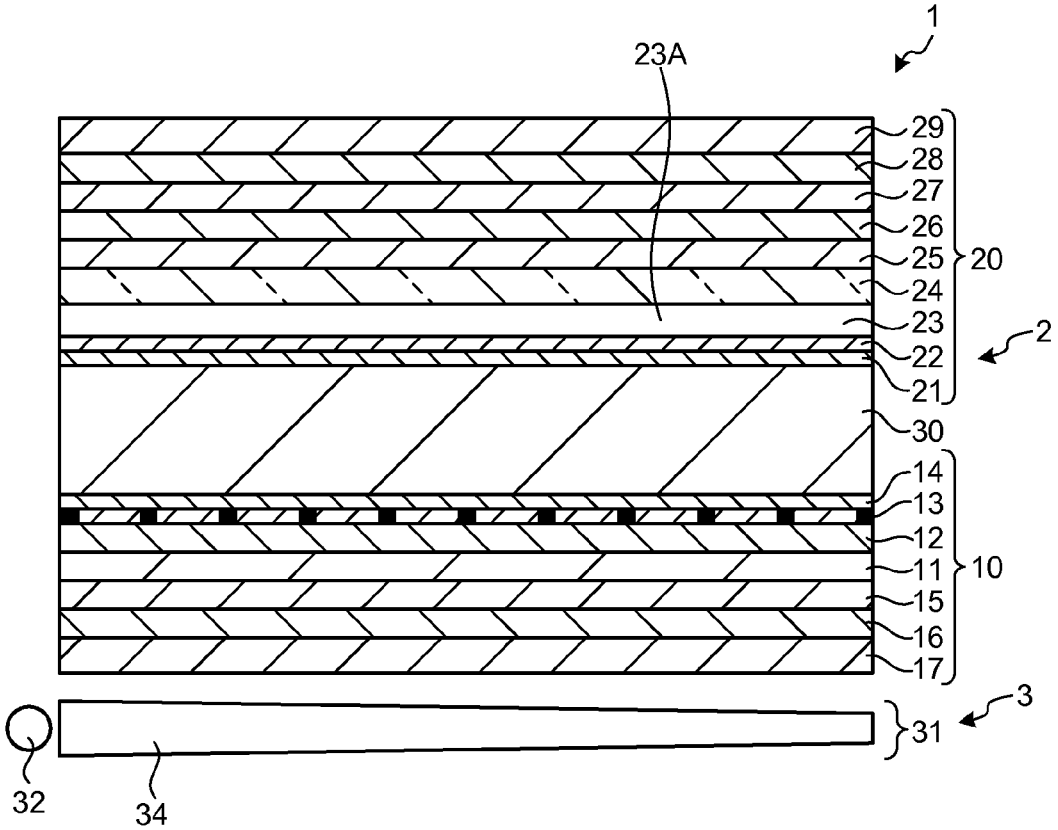
FIG. 2 is a sectional view of an example of a configuration of a liquid crystal module and a light source module of the display device illustrated in FIG. 1.

FIG. 1 is a block diagram of an example of a configuration of a display device according to an embodiment of the present disclosure. FIG. 2 is a sectional view of an example of a configuration of a liquid crystal module and a light source module of the display device illustrated in FIG. 1. FIG. 2 schematically illustrates the configuration and does not necessarily illustrate it in actual size and shape. A display device 1 corresponds to a specific example of the "display device" according to the present disclosure. The display device 1 is a transflective display device and includes a liquid crystal module 2, a light source module 3, a drive circuit 40, a controller 42, and a state detecting unit 44, for example, as illustrated in FIG. 1. The drive circuit 40 drives the liquid crystal module 2 and the light source module 3. The controller 42 controls the drive circuit 40. The state detecting unit 44 detects a state related to the display device 1. As illustrated in FIG. 2, the liquid crystal module 2 includes a lower substrate 10, an upper substrate 20, and a liquid crystal layer 30 interposed between the lower substrate 10 and the upper substrate 20. The light source module 3 includes a backlight unit 31 arranged on the side of the lower substrate 10 opposite to the liquid crystal layer 30. The liquid crystal layer 30 corresponds to a specific example of a "liquid crystal layer" according to the present disclosure. The controller 42 corresponds to a specific example of a "controller" according to the present disclosure.

In the display device 1, the upper surface of the upper substrate 20 (e.g., a polarizing plate 29, which will be described later) serves as a display surface. The backlight unit 31 is arranged at the back of the lower substrate 10. In other words, the display device 1 can display an image by the two following methods: a reflection method for displaying an image by reflecting light incident from the display surface; and a transmission method for displaying an image by transmitting light incident from the back of the lower substrate 10.

Liquid Crystal Layer 30

The liquid crystal layer 30 includes nematic liquid crystal, for example. The liquid crystal layer 30 is driven in accordance with a video signal. The liquid crystal layer 30 has a modulation function to transmit or block light incident on the liquid crystal layer 30 for each pixel by application of a voltage in accordance with the video signal.

Lower Substrate 10

As illustrated in FIG. 2, the lower substrate 10 includes a drive substrate 11 on which thin film transistors (TFTs) are formed, an insulating layer 12 that covers the TFT and other components, a reflective electrode layer 13 electrically connected to the TFT and other components, an orientation film 14 formed on the upper surface of the reflective electrode layer 13, a quarter-λ plate 15, a half-λ plate 16, and a polarizing plate 17, for example. The reflective electrode layer 13 corresponds to a specific example of "a plurality of pixel electrodes" according to the present disclosure. The lower substrate 10 is formed of the orientation film 14, the reflective electrode layer 13, the insulating layer 12, the drive substrate 11, the quarter-λ plate 15, the half-λ plate 16, and the polarizing plate 17 stacked in this order from the surface in contact with the liquid crystal layer 30.

The drive substrate 11 has pixel circuits each obtained by forming a TFT, a capacitive element, and other component on a transparent substrate made of a glass substrate, for example. The transparent substrate may be made of a material other than a glass substrate, including a translucent resin substrate and a quartz substrate, for example.

Figure 3:
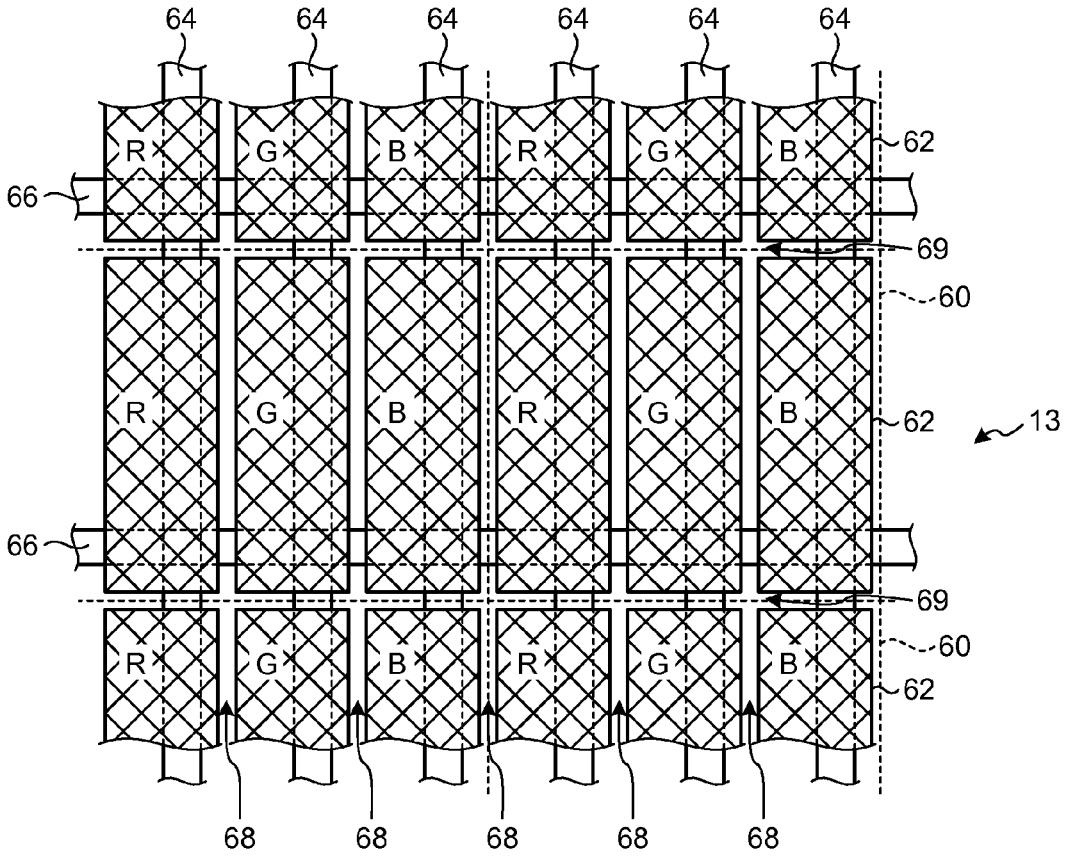
FIG. 3 is a plane view of an example of an arrangement pattern of reflective electrodes in the display device illustrated in FIG. 2.

The reflective electrode layer 13 drives the liquid crystal layer 30 with the potential difference between the reflective electrode layer 13 and a transparent electrode layer 22 of the upper substrate 20, which will be described later. FIG. 3 is a plane view of an example of an arrangement pattern of reflective electrodes in the display device illustrated in FIG. 2. In the reflective electrode layer 13, pixel electrodes 62 each corresponding to one pixel 60 are arranged two-dimensionally as illustrated in FIG. 3. In the reflective electrode layer 13, one pixel electrode 62 corresponds to a sub-pixel of one color, and each pixel 60 includes a plurality of pixel electrodes 62. The pixel electrode 62 of the reflective electrode layer 13 is connected to wires 64 and 66 via the TFT. The wire 64 and the wire 66 are a signal line and a gate line, respectively. The wires 64 extend in a direction orthogonal to the wires 66. While the wire 64 and the wire 66 are described as an example of wires formed in the pixel unit in the present embodiment, the wires formed in the pixel are not limited thereto. Specifically, the wires include all the drive wires (control wires) required for driving (controlling) the pixel electrode 62.

The reflective electrode layer 13 has an opening (also referred to as a space or a gap) 68 or 69 between the pixel electrode 62 and a pixel electrode 62 adjacent thereto. The opening 68 extends along an array direction of pixels of a pixel column, that is, along a column direction (vertical direction in FIG. 3). The opening 69 extends along an array direction of pixels of a pixel row, that is, along a row direction (horizontal direction in FIG. 3). In other words, the opening 68 is adjacent to a side orthogonal to a side adjacent to the opening 69, among sides of the pixel electrode 62. A pair of the openings 68 and a pair of the openings 69 are adjacent to two opposite sides of the outline of the pixel electrode 62, respectively. Accordingly, each of the pixel electrodes 62 is surrounded by a pair of the openings 68 and a pair of the openings 69.

The wires 64 and 66 are arranged so as not to fill the openings 68 and 69. Specifically, the wires 64 and 66 are each arranged such that the position thereof in a direction orthogonal to the extending direction overlaps with the pixel electrode 62. Forming the wires 64 and 66 so as not to fill the openings 68 and 69 between the pixel electrodes 62 of the reflective electrode layer 13 enables transmissive display using the space as a transmissive display area.

"Not to fill the spaces (openings)" does not mean absence of an area in which the wire 64 or 66 overlaps with the opening 68 or 69 between the pixel electrodes 62 of the reflective electrode layer 13. Specifically, as illustrated in FIG. 3, the concept of "not to fill the spaces (openings)" includes: a state where the wire 64 arranged in the column direction overlaps with the opening 69 extending in the row direction; and a state where the wire 66 arranged in the row direction overlaps with the opening 68 extending in the column direction.

The concept of "not to fill the spaces (openings)" also includes: a state where the wire 64 partially or in a part thereof overlaps with the opening 68 extending in the column direction; and a state where the wire 66 partially or in a part thereof overlaps with the opening 69 extending in the row direction. In both cases, the display device 1 uses areas in which no wire 64 or no wire 66 overlaps with the openings 68 and 69 as the transmissive display area.

To form the wires so as not to fill the openings 68 and 69 between the pixel electrodes 62 of the reflective electrode layer 13, the wires are preferably formed in a manner avoiding at least either one of the openings 68 and 69 between the pixel electrodes 62 of the reflective electrode layer 13. "Avoiding the space (opening)" means a state where the wire is not present in the opening 68 or 69 between the pixel electrodes 62 of the reflective electrode layer 13 (that is, at least either one of the openings 68 and 69 has no area in which the wire overlaps therewith).

Specifically, as illustrated in FIG. 3, the wire 64 is preferably arranged in a manner avoiding the opening 68 extending in the column direction, that is, with no area (portion) thereof overlapping with the opening 68. The wire 66 is preferably arranged in a manner avoiding the opening 69 extending in the row direction, that is, with no area thereof overlapping with the opening 69. The openings 68 and 69 between the pixel electrodes 62 of the reflective electrode layer 13 have no area in which the wires 64 and the wires 66 overlap therewith, respectively. This enables the use of the substantially whole area of the openings 68 and 69 as the transmissive display area. This can provide higher transmissive display performance.

As described above, the display device 1 performs transmissive display using the openings between the pixel electrodes 62 of the reflective electrode layer 13, that is, uses the area of the openings as the transmissive display area. Thus, it is not necessary to secure the transmissive display area separately in the pixel electrode 62. This can make the size of the reflective electrode layer 13 equivalent to that of a reflective liquid crystal display device with the pixel electrodes 62 in the same size. As a result, the display device 1 can perform transmissive display while maintaining reflective display performance equivalent to that of the reflective display device.

When the drive circuit 40 applies a voltage to the pixel electrode 62 and the transparent electrode layer 22, an electric field corresponding to the potential difference between the pixel electrode 62 and the transparent electrode layer 22 is generated between them. The liquid crystal layer 30 is driven depending on the magnitude of the electric field. A portion of the display device 1 corresponding to the portion in which the pixel electrode 62 and the transparent electrode layer 22 face to each other serves as a base unit capable of partially driving the liquid crystal layer 30 by the voltage applied between the pixel electrode 62 and the transparent electrode layer 22. The base unit corresponds to a pixel. The reflective electrode layer 13 also serves as a reflective layer that reflects ambient light incident via the liquid crystal layer 30 toward the liquid crystal layer 30. The reflective electrode layer 13 is made of a conductive material that reflects visible light, such as a metal material including Ag and Al. The surface of the reflective electrode layer 13 is formed into a mirror surface, for example.

Figure 4A:
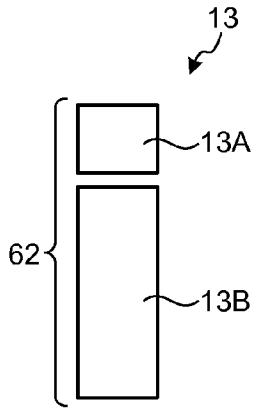
FIG. 4A is a plane view of an example of a configuration of a pixel in the display device illustrated in FIG. 2.
Figure 4B:
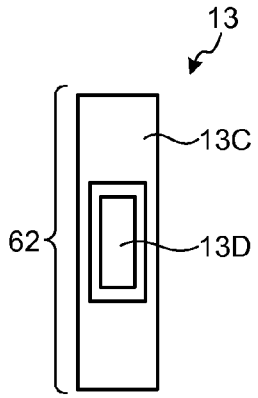
FIG. 4B is a plane view of an example of a configuration of a pixel in the display device illustrated in FIG. 2.
Figure 4C:
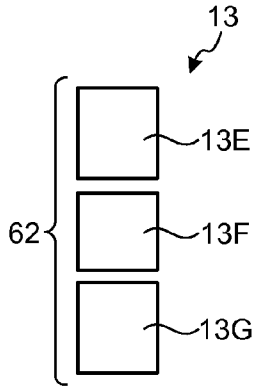
FIG. 4C is a plane view of an example of a configuration of a pixel in the display device illustrated in FIG. 2.

Each pixel electrode 62 may include a plurality of partial electrodes. Connection of the partial electrodes to the wires 62 and 64 via respective different TFTs makes it possible to perform area coverage modulation display. Setting the area ratio of the partial electrodes 2:1 enables the pixel electrode 62 to achieve area coverage modulation in 2-bits of 0, 1, 2, and 3, for example. The pixel electrode 62 illustrated in FIG. 4A is formed of a partial electrode 13A and a partial electrode 13B having an area approximately twice larger than that of the partial electrode 13A arranged parallel to each other. The partial electrodes 13A and 13B are connected to the wires 62 and 64 via respective different TFTs. The pixel electrode 62 may be formed of a partial electrode 13C having an opening and a partial electrode 13D arranged in the opening of the partial electrode 13C as illustrated in FIG. 4B. The pixel electrode 62 may be formed of three partial electrodes 13E, 13F, and 13G having the same area arranged in a line as illustrated in FIG. 4C. In the case of the pixel electrode 62 illustrated in FIG. 4C, the partial electrodes 13E and 13G among the three partial electrodes are electrically connected to each other and connected to the wires 62 and 64 via a single TFT. The partial electrode 13F is connected to the wires 62 and 64 via another TFT. This configuration can achieve area coverage modulation in 2-bits while maintaining the center of gravity.

The orientation film 14 aligns liquid crystal molecules in the liquid crystal layer 30 in a predetermined direction and is directly in contact with the liquid crystal layer 30. The orientation film 14 is made of a high-molecular material, such as polyimide, and is obtained by performing rubbing treatment on applied polyimide, for example.

The quarter-λ plate 15 is a uniaxially stretched resin film, for example. The retardation of the quarter-λ plate 15 is 0.14 μm, for example, which is equivalent to approximately one-fourth of the wavelength of green light having the highest luminosity in visible light. The quarter-λ plate 15 converts linearly polarized light incident thereon into circularly polarized light or converts circularly polarized light incident thereon into linearly polarized light. The quarter-λ plate 15 according to the present embodiment converts linearly polarized light incident from the polarizing plate 17 side, that is, from the backlight unit 31 side into circularly polarized light. The half-λ plate 16 is a uniaxially stretched resin film, for example. The retardation of the half-λ plate 16 is 0.27 μm, for example, which is equivalent to approximately one-half of the wavelength of green light having the highest luminosity in visible light. The half-λ plate 16 rotates the polarization plane of incident light 90 degrees. The quarter-λ plate 15 and the half-λ plate 16, as a whole of the quarter-λ plate 15 and the half-λ plate 16, convert linearly polarized light incident from the polarizing plate 17 side into circularly polarized light. The quarter-plate λ and the half-λ plate 16 function as a (broadband) circularly polarizing plate for a wide range of wavelengths. The polarizing plate 17 absorbs linear polarization components in a predetermined direction and transmits polarization components in a direction orthogonal thereto. The polarizing plate 17 converts light incident from the backlight unit 31 side into linearly polarized light.

Upper Substrate 20

As illustrated in FIG. 2, the upper substrate 20 includes an orientation film 21, the transparent electrode layer 22, a color filter (CF) layer 23, and a transparent substrate 24 stacked in this order from the liquid crystal layer 30 side, for example.

The orientation film 21 aligns liquid crystal molecules in the liquid crystal layer 30 in a predetermined direction and is directly in contact with the liquid crystal layer 30. The orientation film 21 is made of a high-molecular material, such as polyimide, and is obtained by performing rubbing treatment on applied polyimide, for example.

The transparent electrode layer 22 is arranged in a manner facing respective pixel electrodes and is a sheet electrode formed on the whole plane, for example. Because the transparent electrode layer 22 is arranged in a manner facing respective pixel electrodes, the transparent electrode layer 22 serves as a common electrode for the pixels. The transparent electrode layer 22 is made of a conductive material that transmits ambient light, such as an indium tin oxide (ITO).

The CF layer 23 is provided with a color filter 23A in an area facing the pixel electrodes. The color filter 23A is obtained by arranging, correspondingly to the pixels, a color filter that separates light passing through the liquid crystal layer 30 into the three primary colors of red, green, and blue, for example. The transparent substrate 24 is a transparent substrate for ambient light, such as a glass substrate.

As illustrated in FIG. 2, the upper substrate 20 includes a light diffusion layer 25, a light diffusion layer 26, a quarter-λ plate 27, a half-λ plate 28, and the polarizing plate 29 stacked on the upper surface of the transparent substrate 24 in this order from the liquid crystal layer 30 side, for example. The light diffusion layer 25, the light diffusion layer 26, the quarter-λ plate 27, the half-λ plate 28, and the polarizing plate 29 are each bonded with other layers adjacent thereto with an adhesion layer or a bonding layer, for example. The quarter-λ plate 15 and the half-λ plate 16, and the quarter-λ plate 27 and the half-λ plate 28 correspond to a specific example of a "phase difference layer" according to the present disclosure. The polarizing plates 17 and 29 correspond to a specific example of a "polarizing plate" according to the present disclosure.

The light diffusion layers 25 and 26 are forward scattering layers that generate large forward scattering and small backward scattering. The light diffusion layers 25 and 26 are anisotropic scattering layers that scatter light incident thereon in a specific direction. When light is incident on the light diffusion layers 25 and 26 in the specific direction from the polarizing plate 29 side with respect to the upper substrate 20, the light diffusion layers 25 and 26 transmit the incident light almost without scattering the light. The light diffusion layers 25 and 26 significantly scatter the light reflected and returned by the reflective electrode layer 13.

Figure 5A:
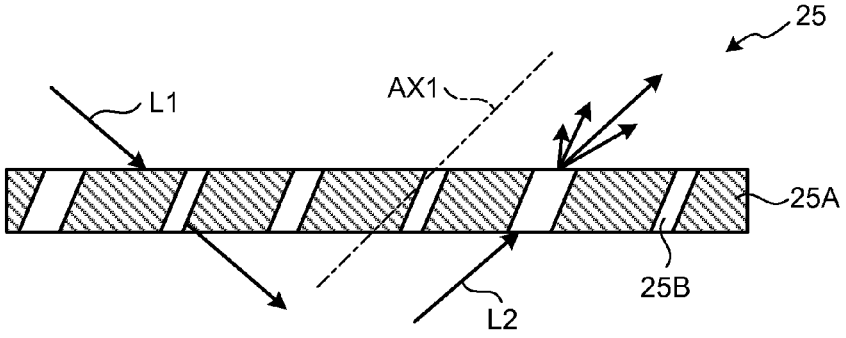
FIG. 5A is a sectional view of an example of a structure of a light diffusion layer illustrated in FIG. 2.
Figure 5B:
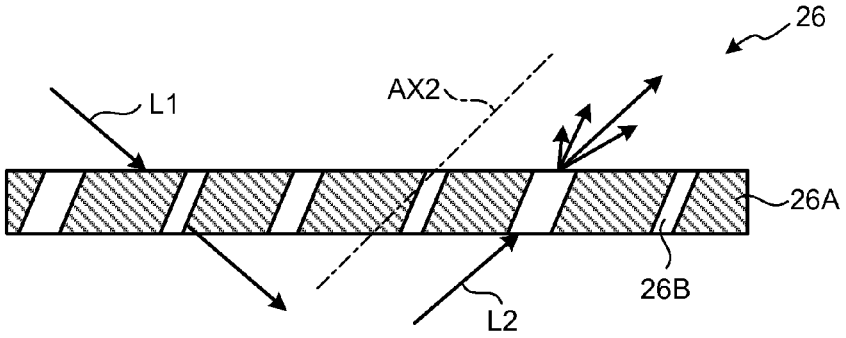
FIG. 5B is a sectional view of an example of a structure of another light diffusion layer illustrated in FIG. 2.

As illustrated in FIG. 5A, the light diffusion layer 25 transmits external light L1 when external light L1 is incident thereon in a predetermined direction with respect to the upper substrate 20, for example. The light diffusion layer 25 scatters, among the transmitted light, light L2 reflected by the reflective electrode layer 13 within a predetermined range with respect to a scattering central axis AX1. As illustrated in FIG. 5B, the light diffusion layer 26 transmits external light L1 when external light L1 is incident thereon in a predetermined direction with respect to the upper substrate 20, for example. The light diffusion layer 26 scatters, among the transmitted light, light L2 reflected by the reflective electrode layer 13 within a predetermined range with respect to a scattering central axis AX2. The external light L1 is parallel light incident on the polarizing plate 29 of the upper substrate 20. The external light L1 may be non-polarized light or polarized light.

As illustrated in FIG. 5A, the light diffusion layer 25 includes two types of areas (a first area 25A and a second area 25B) having different refractive indexes, for example. Similarly, as illustrated in FIG. 5B, the light diffusion layer 26 includes two types of areas (a first area 26A and a second area 26B) having different refractive indexes, for example. FIG. 5A and FIG. 5B illustrate examples of a sectional structure of the light diffusion layers 25 and 26, respectively. In the light diffusion layers 25 and 26, the two types of areas having different refractive indexes may be formed in a louver structure or in a columnar structure.

The light diffusion layer 25 is formed of the first area 25A and the second area 25B extending in the thickness direction and inclined in a predetermined direction, for example. The light diffusion layer 26 is formed of the first area 26A and the second area 26B extending in the thickness direction and inclined in a predetermined direction, for example. The light diffusion layers 25 and 26 are each formed by irradiating a resin sheet that is a mixture of two or more types of monomers or oligomers capable of being photopolymerized and having different refractive indexes with ultraviolet rays in an oblique direction, for example. The light diffusion layers 25 and 26 may have a structure different from the structure described above and may be manufactured by a method different from the method described above. The light diffusion layers 25 and 26 may have the same structure or structures different from each other.

The scattering center axes AX1 and AX2 of the light diffusion layers 25 and 26, respectively, preferably extend in the same direction, such as a main visual angle direction. The scattering center axes AX1 and AX2 do not necessarily extend in the same direction. One of the scattering center axes AX1 and AX2 may extend in the main visual angle direction, and the other of the scattering center axes AX1 and AX2 may extend in a direction different from the main visual angle direction, for example. Alternatively, both the scattering center axes AX1 and AX2 may extend in a direction different from the main visual angle direction. In any cases, the directions of the scattering center axes AX1 and AX2 simply need to be set such that the use of the light diffusion layers 25 and 26 makes the luminance in the main visual angle direction the highest (that is, makes the reflectance the highest) because of the effect of the light diffusion layers 25 and 26.

The main visual angle corresponds to a direction in which a user of the display device 1 sees the display surface when using the display device 1. When the display surface is formed in a rectangular shape, the main visual angle corresponds to a direction orthogonal to a side closest to the user among the sides of the display surface.

Figure 6:
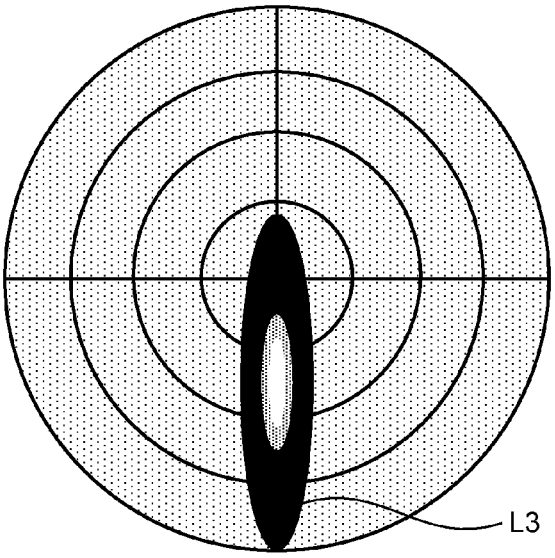
FIG. 6 is a view of an example of viewing angle characteristics of the light diffusion layer illustrated in FIG. 2.

As illustrated in FIG. 6, assuming that the vertical direction of FIG. 6 corresponds to the main visual angle, the scattered light generated by the light diffusion layers 25 and 26 is distributed in a band-shape from a polar angle of 0 degrees to 90 degrees in the main visual angle direction, for example. FIG. 6 is a view of an example of viewing angle characteristics of the light diffusion layers 25 and 26. A portion represented by "scattered light L3" in FIG. 6 corresponds to distribution of the scattered light generated by the light diffusion layers 25 and 26.

The quarter-λ plate 27 is a member similar to the quarter-λ plate 15 and is a uniaxially stretched resin film, for example. The quarter-λ plate 27 converts linearly polarized light incident from the polarizing plate 29 side into circularly polarized light. The half-λ plate 28 is a member similar to the half-λ plate 16 and is a uniaxially stretched resin film, for example. The quarter-λ plate 27 and the half-λ plate 28, as a whole of the quarter-λ plate 27 and the half-λ plate 28, convert linearly polarized light incident from the polarizing plate 29 side into circularly polarized light. The quarter-λ plate 27 and the half-λ plate 28 function as a (broadband) circularly polarizing plate for a wide range of wavelengths. The phase difference between turning ON and OFF of the liquid crystal is set to λ/4. Because the light reflected by the reflective plate passes through the liquid crystal twice, the phase difference between turning ON and OFF of the liquid crystal is set to λ/k. When circularly polarized light entering the liquid crystal is reflected and returned, the circularly polarized light is thus converted into right or left circularly polarized light depending on the ON/OFF state of the liquid crystal. Subsequently, when passing through the quarter-λ plate 27 and the half-λ plate 28, the circularly polarized light is converted into linearly polarized light parallel to or orthogonal to the absorption axis of polarization depending on the ON/OFF state of the liquid crystal. The polarizing plate 29 absorbs linear polarization components parallel to the absorption axis of the polarizing plate and transmits polarization components orthogonal thereto. The polarizing plate 29 converts external light incident from the outside into linearly polarized light and transmits or blocks the light reflected by the reflective plate depending on the ON/OFF state of the liquid crystal.

Figure 7A:
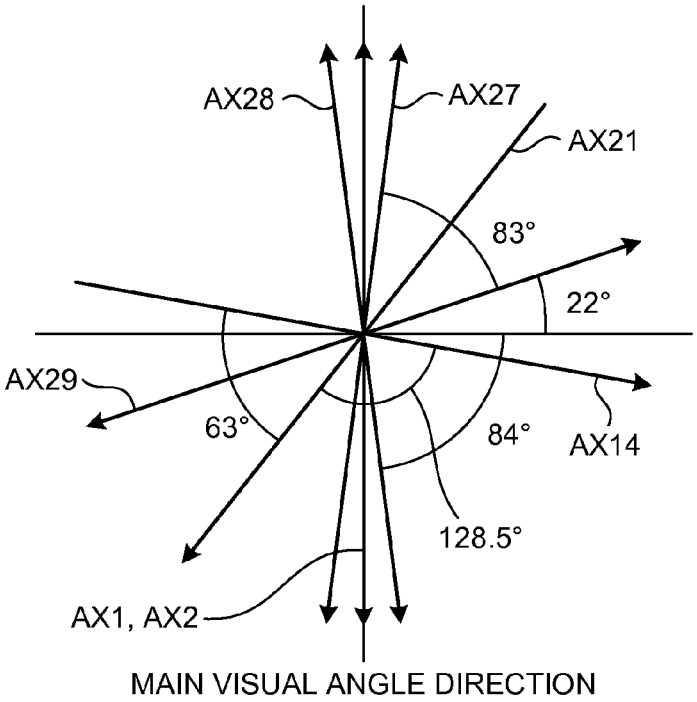
FIG. 7A is a view of an example of a relation among a transmission axis, an optical axis, a scattering central axis, and a rubbing direction of components of the display device viewed from the display surface side.
Figure 7B:
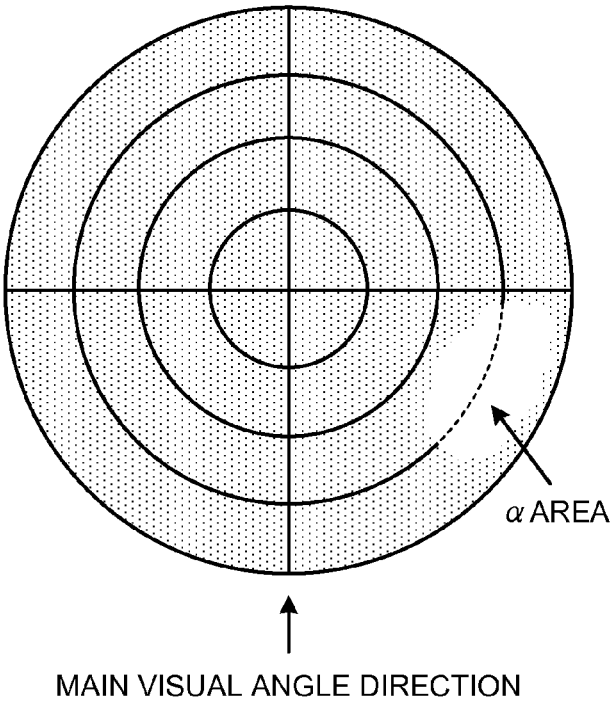
FIG. 7B is a view of an example of a direction in which a flicker is made conspicuous in the display device having the configuration illustrated in FIG. 7A.

The LCD panel, which includes the lower substrate 10, the upper substrate 20, and the liquid crystal layer 30, is configured such that, when the light diffusion layers 25 and 26 are not provided, a direction in which a flicker is made the most conspicuous is different from the main visual angle. The LCD panel is configured such that, when the light diffusion layers 25 and 26 are provided, the direction in which a flicker is made the most conspicuous is deviated from the main visual angle by tens of degrees, for example. The display device 1, for example, has the following configuration: a transmission axis AX29 of the polarizing plate 29, an optical axis AX28 of the half-λ plate 28, an optical axis AX27 of the quarter-λ plate 27, the scattering central axis AX2 of the light diffusion layer 26, the scattering central axis AX1 of the light diffusion layer 25, a rubbing direction AX21 of the orientation film 21, and a rubbing direction AX14 of the orientation film 14 are set as illustrated in FIG. 7A viewed from the display surface side. This configuration makes a flicker conspicuous in an area cc deviated from the main visual angle but makes a flicker inconspicuous in the main visual angle direction as illustrated in FIG. 7B.

Backlight Unit 31

The backlight unit 31 is an illuminating unit that illuminates the LCD panel from the back side of the panel, that is, from the side of the lower substrate 10 opposite to the liquid crystal layer 30. The backlight unit 31 includes a light source 32 and a light guide plate 34. The light source 32 is a light source outputting light, including a light-emitting diode (LED) or a fluorescent tube, for example. The light guide plate 34 is arranged in a manner facing the surface of the lower substrate 10 opposite to the liquid crystal layer 30. The light guide plate 34 causes light, which is output from the light source 32 and enters the inside of the light guide plate 34, to be output through the surface of the lower substrate 10 opposite to the liquid crystal layer 30. The light guide plate 34 scatters and reflects the light output from the light source 32 and entering the inside of the light guide plate 34. This enables the light guide plate 34 to irradiate the surface of the lower substrate 10 opposite to the liquid crystal layer 30 with light having high in-plane uniformity. The backlight unit 31 is not limited to the configuration according to the present embodiment. The backlight unit 31 may be provided with well-known members, such as a prism sheet and a diffusion sheet, in addition to the light source 32 and the light guide plate 34.

Pixel

Figure 8:
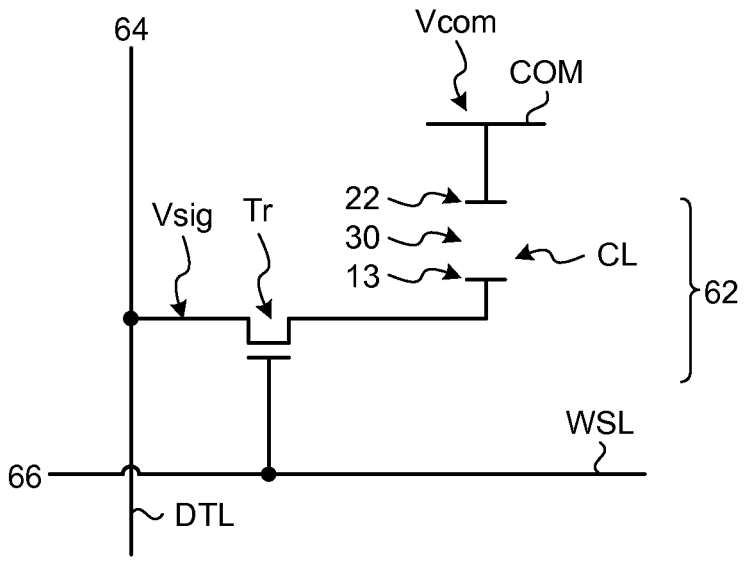
FIG. 8 is a circuit diagram of an example of a configuration of a pixel electrode in the display device illustrated in FIG. 2.

FIG. 8 illustrates an example of a circuit configuration in the lower substrate 10. The lower substrate 10 includes a plurality of scanning lines WSL arranged as rows, a plurality of signal lines DTL arranged as columns, and pixels 62 corresponding to respective pixel electrodes. As illustrated in FIG. 8, the pixels 62 are provided correspondingly to respective portions where the scanning lines WSL and the signal lines DTL intersect with each other, for example. The lower substrate 10 further includes a plurality of band-shaped common connecting lines COM each provided commonly to a pixel row, for example. The scanning lines WSL correspond to the wires 66 illustrated in FIG. 3, and the signal lines DTL correspond to the wires 64 illustrated in FIG. 3.

As illustrated in FIG. 8, each pixel 62 includes a transistor Tr and a liquid crystal element CL, for example. The transistor Tr is a field-effect TFT, for example, and is formed of a gate that controls a channel and a source and a drain provided on both ends of the channel. The transistor Tr may be a p-type transistor or an n-type transistor. The liquid crystal element CL is formed of the liquid crystal layer 30, the reflective electrode layer 13 provided to one side of the liquid crystal layer 30, and the transparent electrode layer 22 provided to the other side of the liquid crystal layer 30, for example.

The transparent electrode layer 22 is connected to the common connecting line COM, and the reflective electrode layer 13 is connected to one of the source and the drain of the transistor Tr. The gate of the transistor Tr is connected to the scanning line WSL, and the other of the source and the drain of the transistor Tr not being connected to the reflective electrode layer 13 is connected to the signal line DTL. In a plurality of pixels 62 belonging to the same horizontal line, for example, the gates of the transistors Tr are connected to a common scanning line WSL. In other words, the pixels 62 connected to the same scanning line WSL are aligned along the single scanning line WSL.

To use the drive circuit of FIG. 8 in the present disclosure, it is preferable that the liquid crystal perform normally black binary display and that a transistor having low leak characteristics be used as the transistor. Causing the liquid crystal to perform normally black binary display makes it possible to reduce a flicker even in low-frequency driving in reflective display. The use of a transistor having low leak characteristics makes it possible to reduce a flicker caused by a leak of the transistor. An oxide semiconductor In—Ga—$ZnO_4$ (IGZO) is preferably used as a semiconductor material of the transistor. This can achieve both the low leak and write characteristics and the productivity.

Drive Circuit 40

The drive circuit 40 will now be described. The drive circuit 40, for example, includes a video signal processing circuit, a timing generating circuit, a signal line drive circuit, a scanning line drive circuit, a common connecting line drive circuit, and a light source drive circuit, neither of which is illustrated. The arrangement position of the drive circuit 40 is not particularly restricted. A part of the drive circuit 40 according to the present embodiment is arranged in the liquid crystal module 2.

The video signal processing circuit corrects a digital video signal received from the outside and converts the video signal into an appropriate voltage Vsig to output the voltage Vsig to the signal line drive circuit. The timing generating circuit performs control such that the signal line drive circuit and the scanning line drive circuit operate simultaneously with each other. The timing generating circuit outputs a control signal to these circuits in response to (in synchronization with) a synchronization signal received from the outside, for example.

Figure 9:
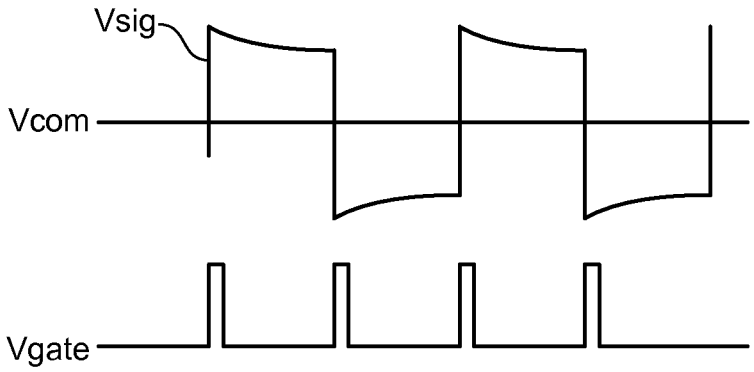
FIG. 9 is a waveform chart of an example of a drive waveform in the display device illustrated in FIG. 2.

The signal line drive circuit converts a video signal received from the video signal processing circuit into an appropriate voltage Vsig and applies the voltage Vsig to each signal line DTL, thereby writing the video signal to a pixel 62 to be selected. As illustrated in FIG. 9, the signal line drive circuit can output the signal voltage Vsig corresponding to the video signal, for example. As illustrated in FIG. 9, the signal line drive circuit applies the signal voltage Vsig (performs 1H inversion driving) to each signal line DTL such that the polarity thereof is inverted in every frame period with respect to a reference voltage (that is, the counter potential Vcom), for example. Thus, the signal line drive circuit can perform driving for writing and holding the video signal in the pixel 62 to be selected. The polarity of the voltage applied to the liquid crystal is inverted in this manner as necessary to prevent deterioration of the liquid crystal element CL. When 1H inversion driving is performed by the signal line drive circuit, the display device 1 may be provided with a black matrix at a portion corresponding to the opening 69 of the color filter 23. When 1H inversion driving is performed by the signal line drive circuit, the display device 1 can fill the opening 69 that does not contribute to transmission of light. This makes it possible to stabilize a response of the liquid crystal.

The scanning line drive circuit applies a selection pulse to the scanning line WSL 66 in response to (in synchronization with) input of the control signal, thereby selecting a plurality of pixels 62 connected to the scanning line in units of a scanning line 66. The scanning line drive circuit can output a voltage Von applied to turn ON the transistors Tr and a voltage Voff applied to turn OFF the transistors Tr, for example. The voltage Von is a value (fixed value) equal to or higher than the ON-voltage of the transistor Tr. The voltage Voff is a value (fixed value) lower than the ON-voltage of the transistor Tr. The scanning lines WSL are configured such that the timings to select respective scanning lines (to apply a voltage equal to or higher than the ON-voltage of the Tr) are shifted. As a result, the voltage of the signal line 64 at the selected timing is written to selected pixel electrodes via the transistors Tr. The electric charge written to the pixel electrodes is held until subsequent data is written. The potential difference between the pixel electrode potential due to the electric charge and the counter electrode potential drives the liquid crystal layer. The frequency of intervals to write data corresponds to the frame frequency. In the circuit illustrated in FIG. 8, the pixel potential is written and the voltage Vcom is applied such that the polarity of the liquid crystal is inverted in each frame.

As illustrated in FIG. 8, the common connecting line drive circuit applies the predetermined voltage Vcom to each common connecting line COM in each frame period, for example. In VcomDC driving, for example, the common connecting line drive circuit does not drive each common connecting line COM but continues to apply a constant voltage thereto while frame inversion driving or 1H inversion driving is being performed. The effective voltage applied to the liquid crystal is preferably constant. Accordingly, the common connecting line drive circuit preferably sets the relation between the signal voltage Vsig and the predetermined voltage Vcom based on coupling with the transistor Tr. As illustrated in FIG. 9, the present embodiment can make the effective value when the electric charge written to each pixel is inverted in each frame period and the effective value applied to the liquid crystal in the case of a voltage V2 substantially equal to each other, thereby reducing a flicker. The Vcom voltage is adjusted such that the effective voltage applied to the liquid crystal (an integrated value of difference between Vsig and Vcom, that is, an area surrounded by Vsig and Vcom in FIG. 9) is the same in positive and negative polarities.

To display an image, the drive circuit 40 can switch the liquid-crystal inversion frequency based on control of the controller 42. Specifically, the drive circuit 40 switches between a first mode and a second mode. The first mode is a mode for driving at a liquid-crystal inversion frequency, which is a first frequency. The second mode is a mode for driving at a liquid-crystal inversion frequency, which is a second frequency, higher than the first frequency. Light mainly used to display an image differs between the first mode and the second mode. Specifically, the first mode is a mode for displaying an image by using mainly light reflected by the pixel electrode 62 of the reflective electrode layer 13 (reflective display mode). The second mode is a mode for displaying an image by using mainly light passing through the openings 68 and 69 of the reflective electrode layer 13 from the backlight unit 31 and reaching the liquid crystal layer 30 (transmissive display mode). These modes will be described later.

The drive circuit 40 can set the liquid-crystal inversion frequency in the first mode to lower than 30 Hz (or 60 fps). More specifically, the drive circuit 40 sets the liquid-crystal inversion frequency in the first mode to a value in a range from 0.05 Hz to lower than 30 Hz to display an image. Setting of the liquid-crystal inversion frequency in the first mode lower, more specifically, setting of the liquid-crystal inversion frequency to lower than 30 Hz will be described later. The drive circuit 40 preferably sets the liquid-crystal inversion frequency in the second mode to a frequency equal to or higher than a critical flicker frequency (CFF). The drive circuit 40 preferably sets the liquid-crystal inversion frequency in the second mode to equal to or higher than 20 Hz.

Figure 10:
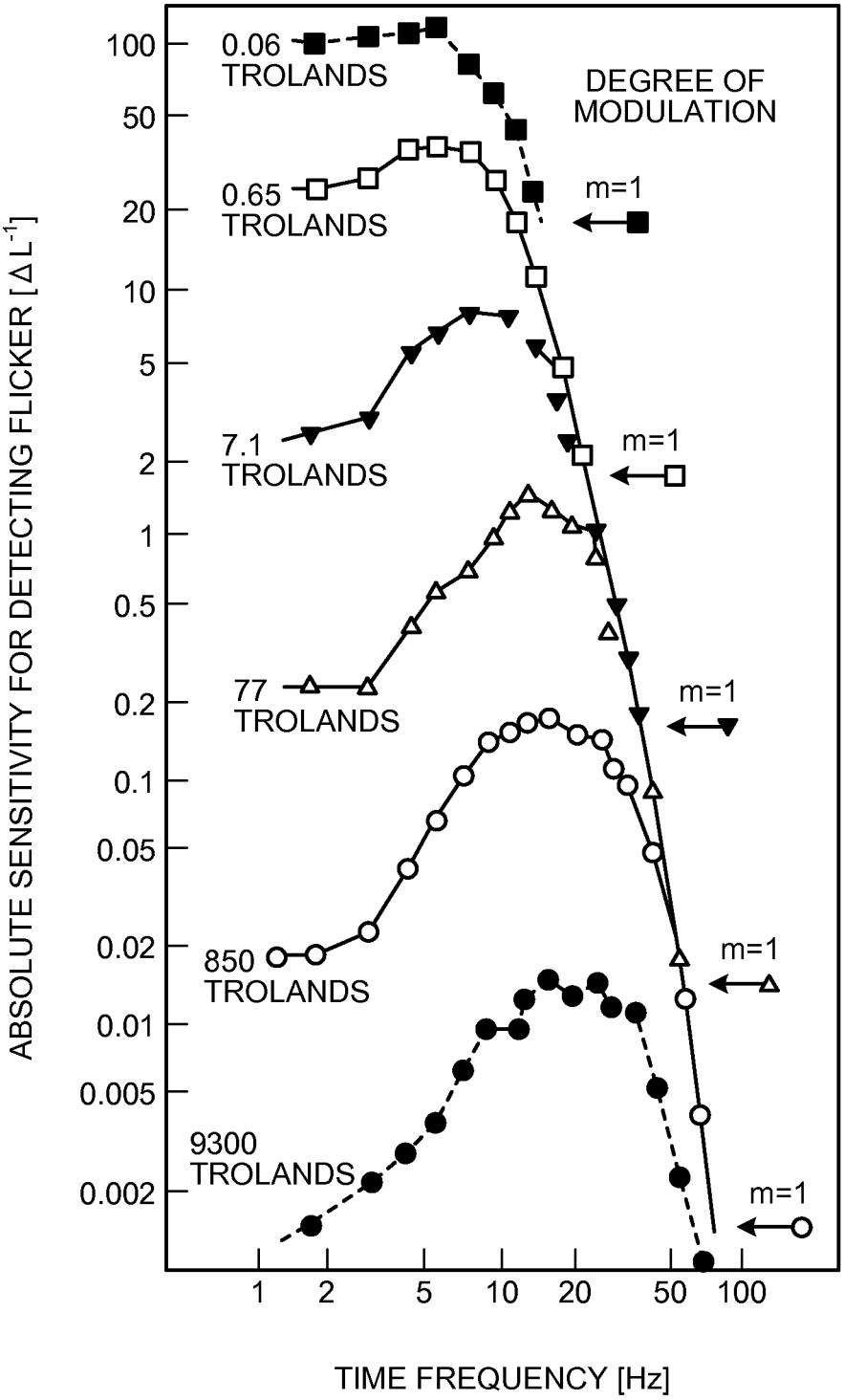
FIG. 10 is a graph of an example of a relation between a time frequency and a flicker.

FIG. 10 is a graph of an example of a relation between time frequency and a flicker. In FIG. 10, the horizontal axis represents time frequency [Hz], and the vertical axis represents absolute sensitivity for detecting a flicker. In FIG. 10, the amount of light that reaches a retina (trolands) is represented as a variable. As the screen becomes darker, the amount of light that reaches a retina (trolands) becomes smaller. (Screen Luminance)×(Opening Degree of Iris) corresponds to (trolands). The time frequency corresponds to the liquid-crystal inversion frequency. FIG. 10 illustrates time frequency characteristics of a difference threshold when the luminance is modulated. A critical flicker frequency (CFF) Fc at which modulated light seems to be fixed light is expressed by: $Fc=a\times\log(I)+b$, where I represents viewing average luminance, and a and b each represent a constant. As indicated by $Fc=a\times\log(I)+b$, as the viewing average luminance, that is, the luminance of light output from the display device increases, the CFF Fc increases.

As indicated in FIG. 10 and the equation of Fc, setting the liquid-crystal inversion frequency to a frequency equal to or higher than the CFF enables the display device 1 to reduce a flicker. It is also found that setting the liquid-crystal inversion frequency equal to or higher than 30 Hz enables the display device 1 to reduce a flicker. Setting the liquid-crystal inversion frequency to equal to or higher than 20 Hz enables the display device 1 to reduce a flicker to some extent. With lower screen luminance, specifically, with screen luminance of equal to or lower than 50 cd/m$^2$, setting the liquid-crystal inversion frequency to equal to or higher than 20 Hz enables the display device 1 to reduce a flicker to some extent.

Controller 42

The controller 42 controls an operation of the drive circuit 40. The controller 42 switches the mode for driving the drive circuit 40 between the first mode and the second mode based on results detected by the state detecting unit 44. The controller 42 transmits a video signal to the drive circuit 40 to control an image to be displayed on the display device 1. The controller 42 also controls turning ON and OFF of the backlight unit 31.

State Detecting Unit 44

The state detecting unit 44 detects the state of the display device 1 and an electronic apparatus provided with the display device 1. The state detecting unit 44 detects a parameter corresponding to a reference for switching the mode between the first mode and the second mode. The state detecting unit 44 according to the present embodiment detects whether the backlight unit 31 is turned ON or OFF. The state detecting unit 44 may detect a condition serving as a trigger for turning ON or OFF the backlight unit 31, or may detect a control signal output to turn ON or OFF the backlight unit 31. While the state detecting unit 44 according to the present embodiment detects turning ON or OFF of the backlight unit 31, the state detecting unit 44 does not necessarily detect it. In the case of the display device 1 switching the mode between the first mode and the second mode depending on the intensity of ambient light, that is, the intensity of external light, for example, the state detecting unit 44 may be provided with an optical sensor that detects the intensity of external light. The state detecting unit 44 transmits the results thus detected to the controller 42. Based on the results detected by the state detecting unit 44, the controller 42 determines the mode for driving the drive circuit 40. The function of the state detecting unit 44 may be incorporated into the controller 42 in the display device 1.

1-2. Advantageous Effects

The following describes advantageous effects of the display device 1 according to the present embodiment.

Figure 11:
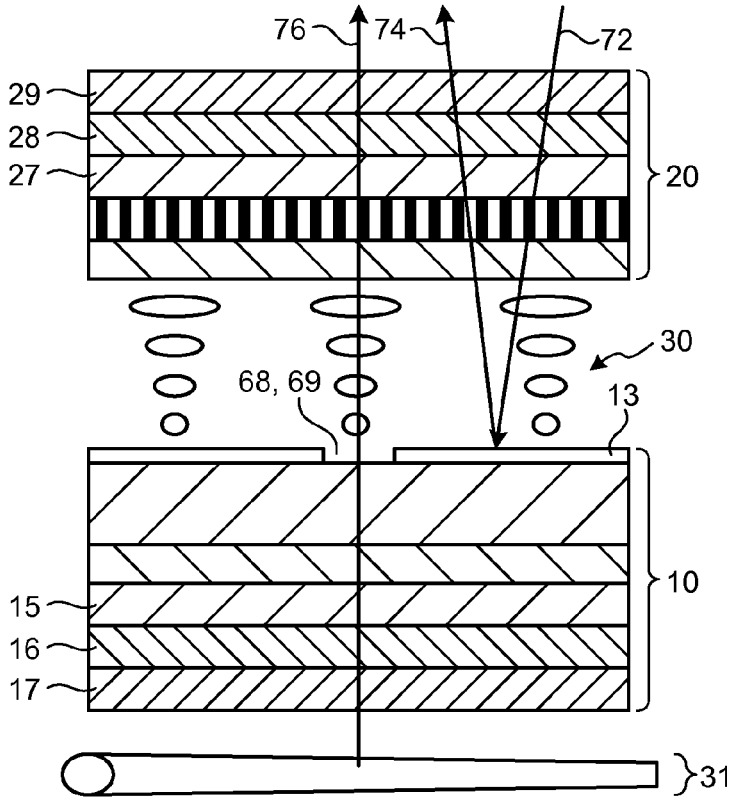
FIG. 11 is a view for explaining an operation of the display device illustrated in FIG. 2.

FIG. 11 is a view for explaining an operation of the display device illustrated in FIG. 2. In the display device 1 according to the present embodiment, for example, ambient light 72 incident in a specific direction passes through the upper substrate 20 and enters the liquid crystal layer 30 as illustrated in FIG. 11. Specifically, the ambient light 72 is converted into linearly polarized light by the polarizing plate 29 of the upper substrate 20. The linearly polarized light is then converted into circularly polarized light by the half-λ plate 28 and the quarter-λ plate 27 and enters the liquid crystal layer 30. The light entering the liquid crystal layer 30 is modulated in accordance with a video signal in the liquid crystal layer 30 and is reflected by the reflective electrode layer 13. The light reflected by the reflective electrode layer 13 passes through the upper substrate 20 and is output to the outside as video light 74. Specifically, the light reflected by the reflective electrode layer 13 is converted into linearly polarized light by the quarter-λ plate 27 and the half-λ plate 28, passes through the polarizing plate 29, and is output to the outside as the video light 74.

In the display device 1, light output from the backlight unit 31 toward the lower substrate 10 passes through the lower substrate 10 and is incident on the reflective electrode layer 13. In the display device 1, light passing through the openings 68 and 69 of the reflective electrode layer 13 among the light incident on the reflective electrode layer 13 enters the liquid crystal layer 30. The light entering the liquid crystal layer 30 is modulated in accordance with a video signal in the liquid crystal layer 30, passes through the upper substrate 20, and is output to the outside as video light 76. Specifically, the light passing through the openings 68 and 69 and through the liquid crystal layer 30 is converted into linearly polarized light by the quarter-λ plate 27 and the half-λ plate 28, passes through the polarizing plate 29, and is output to the outside as the video light 76.

The display device 1 can display an image in two modes of the first mode and the second mode. The first mode is a mode for displaying an image by using the video light 74 as the major component. The second mode is a mode for displaying an image by using the video light 76 as the major component. The controller 42 switches the operation of the drive circuit 40 between the first mode and the second mode. Specifically, the controller 42 changes the liquid-crystal inversion frequency between them.

In the first mode, the controller 42 turns OFF the light source 32 of the backlight unit 31, thereby preventing the backlight unit 31 from outputting light. In the second mode, the controller 42 turns ON the light source 32 of the backlight unit 31, thereby causing the backlight unit 31 to output light. This enables the display device 1 to use the video light 74 as the major component in the first mode and to use the video light 76 as the major component in the second mode. The display device 1 outputs the video light 74 to the outside also in the second mode unless there is no ambient light 72, that is, unless it is dark therearound.

Figure 12:
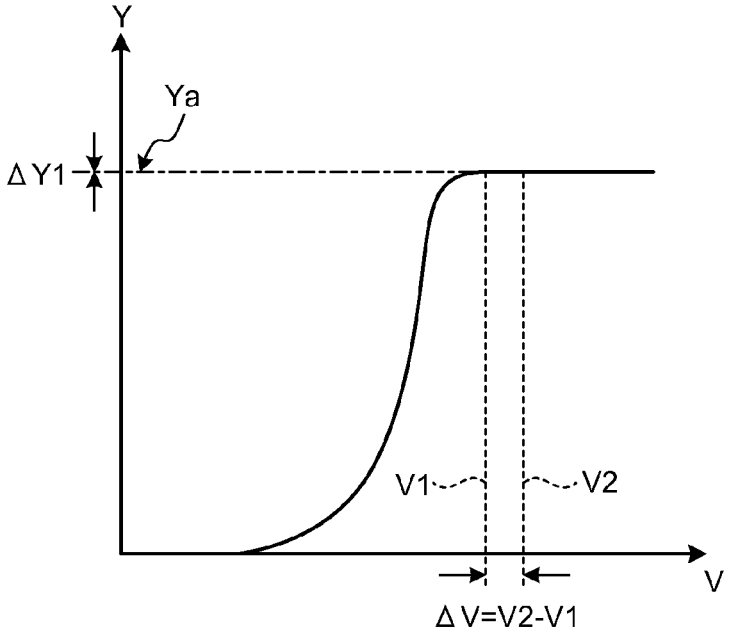
FIG. 12 is a graph of an example of a relation between the applied voltage and the reflectance in a normally black display mode.
Figure 13:
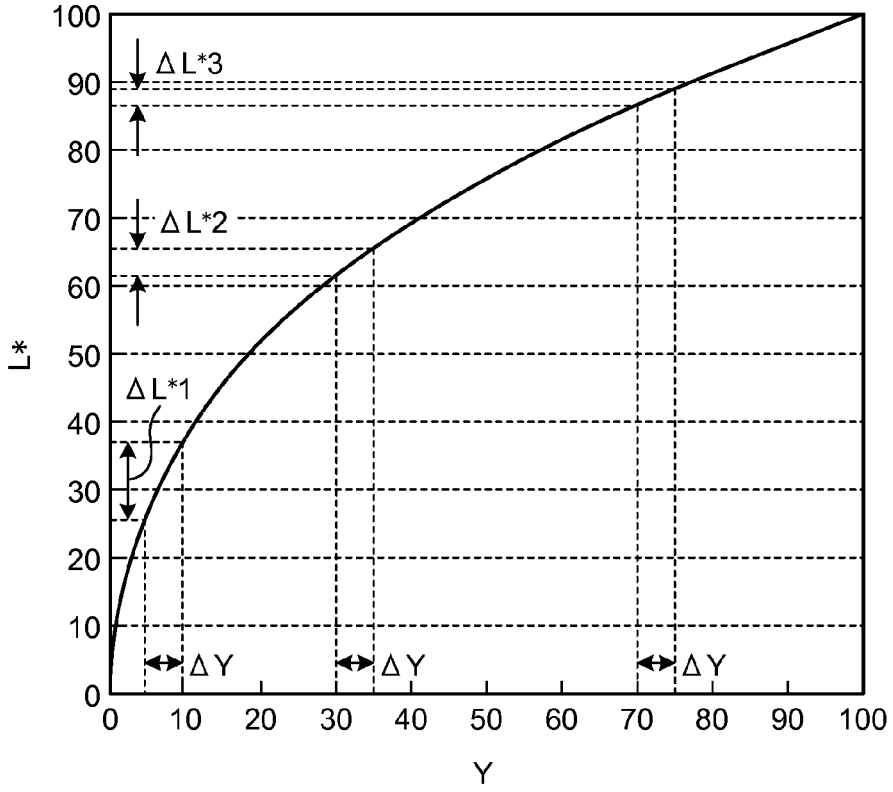
FIG. 13 is a graph of an example of a relation between the reflectance and the lightness.
Figure 14:
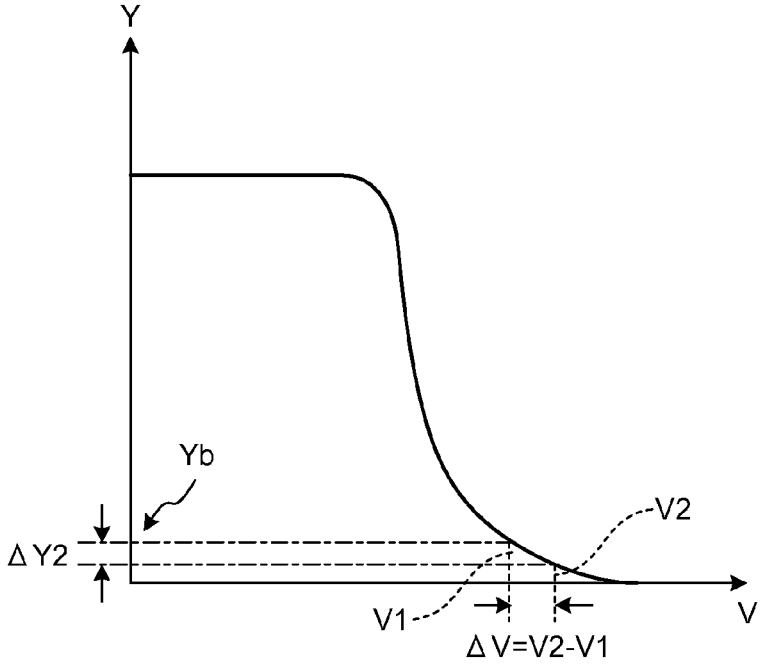
FIG. 14 is a graph of an example of a relation between the applied voltage and the reflectance in a normally white display mode.

FIG. 12 schematically illustrates a relation between an applied voltage V and reflectance Y in a normally black display mode. FIG. 13 schematically illustrates a relation between the reflectance Y and luminance L*. FIG. 14 schematically illustrates a relation between the applied voltage V and the reflectance Y in a normally white display mode as a reference example.

As described above, the LCD panel according to the present embodiment employs the normally black display mode. When the drive circuit 40 applies potential difference V1 to the liquid crystal element CL as a constant voltage that causes the display surface to perform white display, for example, the reflectance of the liquid crystal CL to which the potential difference V1 is applied is predetermined reflectance Ya.

Some optical designs may not allow reflectance difference ΔY to be approximated to zero. Even in this case, assuming that the reflectance difference ΔY is a predetermined value (fixed value) regardless of the magnification of the reflectance Y as illustrated in FIG. 13, for example, lightness difference ΔL* considering the luminosity decreases as the reflectance Y increases (as the luminance increases). Specifically, as illustrated in FIG. 13, lightness difference ΔL*2 considering the luminosity corresponding to the reflectance difference ΔY near a reflectance of 30% is smaller than lightness difference ΔL* 1 considering the luminosity corresponding to the reflectance difference ΔY near a reflectance of 10%. Lightness difference ΔL*3 considering the luminosity corresponding to the reflectance difference ΔY near a reflectance of 70% is smaller than the lightness difference ΔL*2 considering the luminosity corresponding to the reflectance difference ΔY near a reflectance of 30%. Thus, even if the reflectance difference ΔY is a value incapable of being approximated to zero, the LCD panel in the normally black display mode reduces the fluctuation in luminance in white display. As a result, even if the voltage of the common connecting line COM fluctuates, it is possible to reduce a flicker.

As illustrated in FIG. 14, the situation described above does not apply to the case where the LCD panel employs the normally white display mode. In the LCD panel in the normally white display mode, the lightness considering the luminosity in black display fluctuates. The fluctuation in the lightness considering the luminosity in black display becomes a flicker, thereby deteriorating the display quality.

To display an image, the present embodiment sets the liquid-crystal inversion frequency to lower than 30 Hz (or 60 fps). This makes it possible to reduce the power consumption. Because the fluctuation in white luminance can be reduced as described above, a liquid-crystal inversion frequency of lower than 60 Hz does not cause a conspicuous flicker.

As described above, the present embodiment displays an image by the area coverage modulation and in the normally black mode. The area coverage modulation means black-and-white binary gradation performed without halftone gradation. The normally black mode provides stable luminance even if the voltage applied in white display fluctuates. Thus, the present embodiment can provide stable luminance even if the voltage applied to the liquid crystal layer 30 of each pixel 62 is reduced during a frame period in frame inversion driving or 1H inversion driving, for example. Such stable luminance can reduce a flicker even if the drive frequency is set to a low frequency. Accordingly, the present embodiment can reduce the power consumption while reducing a flicker.

Figure 15:
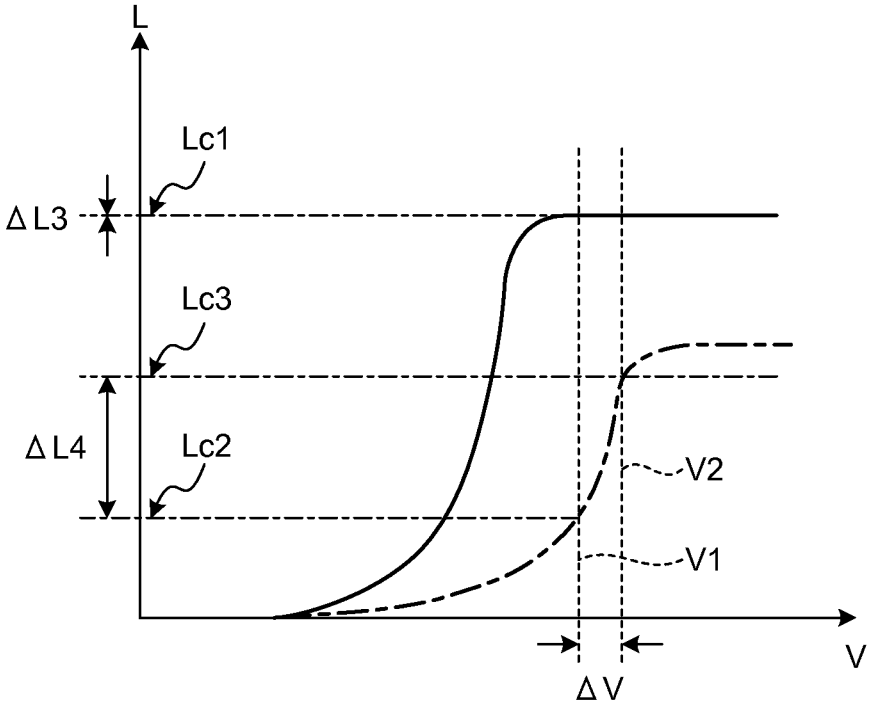
FIG. 15 is a graph of an example of a relation between the applied voltage and the display luminance when the light diffusion layers illustrated in FIG. 2 are not provided.
Figure 16:
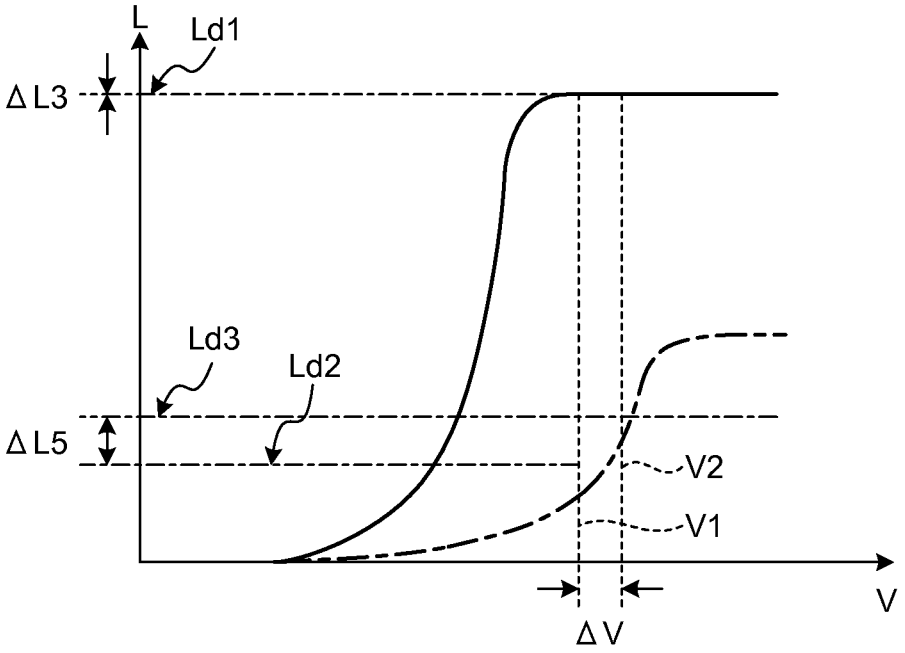
FIG. 16 is a graph of an example of a relation between the applied voltage and the display luminance in the display device illustrated in FIG. 2.

FIG. 15 schematically illustrates a relation between the applied voltage and the display luminance when the light diffusion layers 25 and 26 are not provided. FIG. 16 schematically illustrates a relation between the applied voltage and the display luminance when the light diffusion layers 25 and 26 are arranged at the positions described above. Solid lines in FIG. 15 and FIG. 16 each represent a result obtained when the display surface is seen by a polar angle of equal to or larger than 45 degrees in the main visual angle direction. Dashed-dotted lines in FIG. 15 and FIG. 16 each represent a result obtained when the display surface is seen by a polar angle of equal to or larger than 45 degrees in a direction deviated from the main visual angle by 60 degrees.

As can be seen in FIG. 15 and FIG. 16, providing the light diffusion layers 25 and 26 increases the luminance in the main visual angle direction from Lc1 to Ld1. As can be seen in FIG. 15 and FIG. 16, providing the light diffusion layers 25 and 26 decreases the reduction in luminance in white display during a frame period from ΔL4 to ΔL5 in the direction different from the main visual angle. With the light diffusion layers 25 and 26, the present embodiment can increase the luminance in the main visual angle direction compared with the case where the light diffusion layers 25 and 26 are not provided. In addition, the present embodiment can make a flicker occurring in a direction different from the main visual angle inconspicuous.

As described above, because the light diffusion layers 25 and 26 are provided, the present embodiment can increase the luminance in the main visual angle direction and make a flicker occurring in a direction different from the main visual angle inconspicuous.

Figure 17:
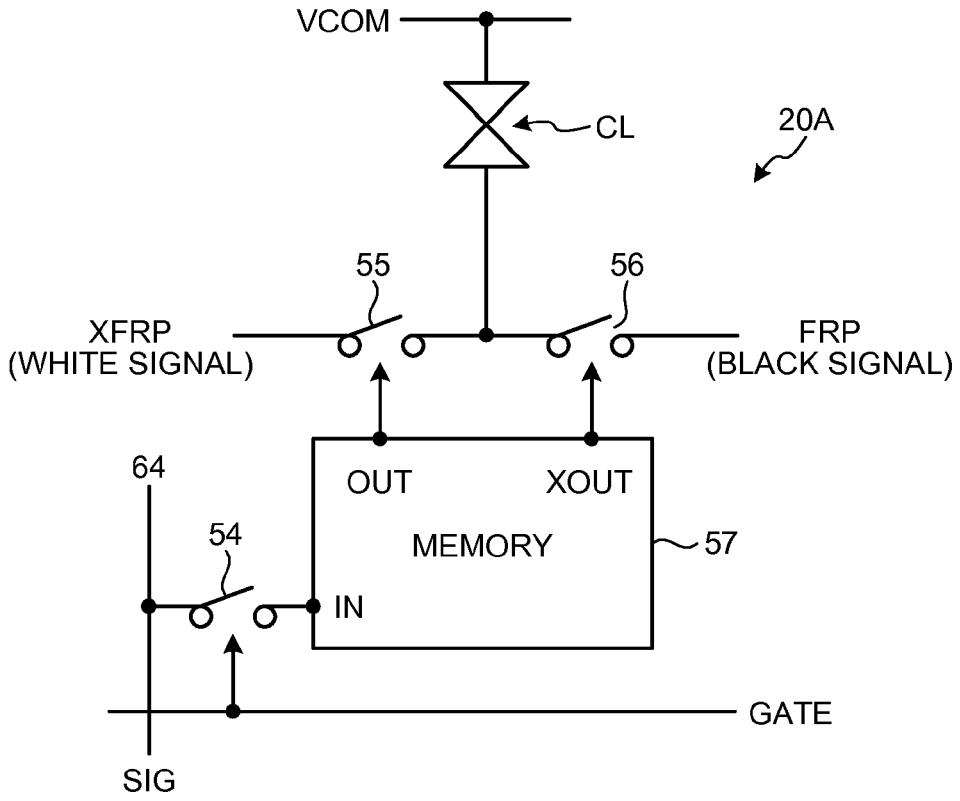
FIG. 17 is a circuit diagram of another example of a configuration of a pixel in the display device illustrated in FIG. 2.
Figure 18:
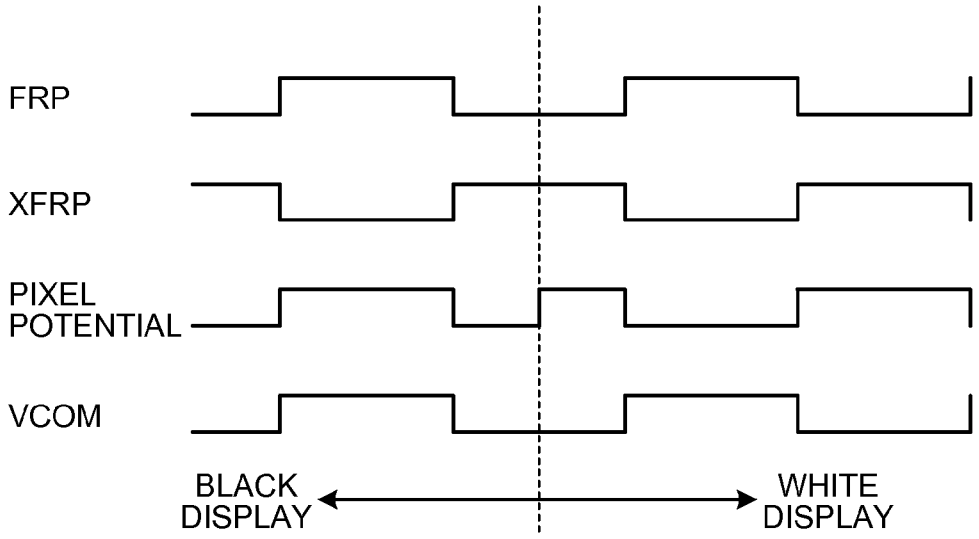
FIG. 18 is a timing chart for explaining an operation of a pixel of the display device illustrated in FIG. 2.

An explanation will be made of processing performed by the display device 1 in the first mode and the second mode. The following describes the case where the display device 1 has a memory function, specifically, memory in pixel (MIP) in each partial electrode of a pixel electrode. A configuration and an operation of a pixel will be described with reference to FIG. 17 and FIG. 18. FIG. 17 is a circuit diagram of another example of a configuration of a pixel in the display device illustrated in FIG. 2. Specifically, FIG. 17 is a block diagram illustrating an exemplary circuit configuration of a pixel of MIP. FIG. 18 is a timing chart for explaining an operation of a pixel of the display device illustrated in FIG. 2.

As illustrated in FIG. 17, a pixel 20A has a pixel configuration with a static random access memory (SRAM) function including three switching elements 54 to 56 and a memory 57 in addition to the liquid crystal element (a liquid crystal capacity, or a liquid crystal cell) CL. The liquid crystal element CL means a liquid crystal capacity formed between a pixel electrode and a counter electrode (transparent electrode) arranged in a manner facing the pixel electrode.

One end of the switching element 54 is connected to the wire 64. The drive circuit 40 supplies a scanning signal GATE to the gate wire 66, thereby bringing the switching element 54 into an ON (open) state. Thus, the switching element 54 retrieves data SIG supplied from the drive circuit 40 via the wire 64. The memory 57 is a latch circuit and is formed of invertors connected in parallel and opposite to each other. The memory 57 holds (latches) the electric potential corresponding to the data SIG retrieved by the switching element 54.

First ends of the switching elements 55 and 56 are supplied with a control pulse XFRP in the reversed phase of the common potential VCOM and a control pulse FRP in the same phase as VCOM, respectively. Second ends of the switching elements 55 and 56 are connected, and the connection node serves as an output node in this pixel circuit. One of the switching elements 55 and 56 is turned ON correspondingly to the polarity of the holding potential in the memory 57. As a result, the control pulse FRP or the control pulse XFRP is applied to the pixel electrode 62 (more specifically, to respective bit components of partial electrodes so as to drive the partial electrodes independently) of the liquid crystal element CL of which counter electrode (transparent electrode layer 22) is supplied with the common potential VCOM.

As is clear from FIG. 18, when the memory 57 selects FRP, the pixel potential of the liquid crystal element CL is in the same phase as the common potential VCOM, resulting in black display in the present embodiment. When the memory 57 selects XFRP, the pixel potential of the liquid crystal element CL is in the reversed phase of the common potential VCOM, resulting in white display. In black display, an area of the liquid crystal layer 30 corresponding to the pixel 20A blocks (cannot transmit) light. In white display, an area of the liquid crystal layer 30 corresponding to the pixel 20A transmits light.

In the display device 1 including the MIP circuit in each pixel electrode 62 according to the present embodiment, one of the switching elements 55 and 56 is turned ON in response to an electric potential (data SIG) written to the memory 57 via the wire 64. As a result, the control pulse FRP or the control pulse XFRP is applied to the pixel electrode 62 of the liquid crystal element CL. Thus, a constant voltage is continuously applied to the pixel electrode 62.

Adding a circuit capable of performing analog display to the MIP circuit provided with a memory that stores therein data in a pixel enables the display device 1 to perform display in an analog display mode and display in a memory display mode. The analog display mode is a display mode for displaying the gradation of a pixel in an analog manner. The memory display mode is a display mode for displaying the gradation of a pixel in a digital manner based on binary information (logic "1"/logic "0") stored in the memory in the pixel. To perform analog display, the display device 1 performs driving at the second frequency described above, thereby preventing a flicker.

Because information stored in the memory is used in the memory display mode, it is not necessary to perform a writing operation of a signal potential reflecting the gradation for each frame period. Thus, the memory display mode requires lower power consumption than the analog display mode in which a writing operation of a signal potential reflecting the gradation needs to be performed for each frame period. In other words, the memory display mode can reduce the power consumption in the display device.

While the explanation has been made of the case where the pixel electrode 62 is provided with an SRAM as the internal memory in the present embodiment, the SRAM is given just as an example. The pixel electrode 62 may be provided with another memory, such as a dynamic random access memory (DRAM), for example.

Figure 19:
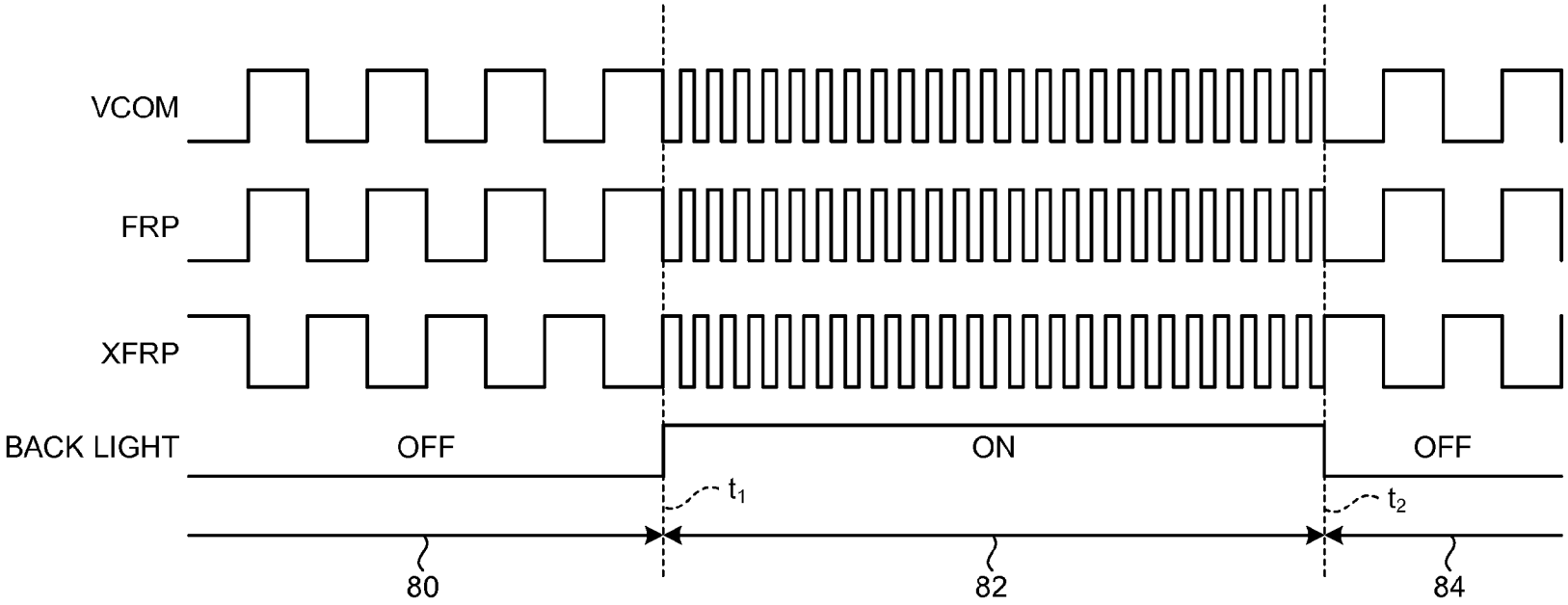
FIG. 19 is a graph of a waveform of a voltage supplied to an MIP.

The display device 1 according to the present embodiment changes the liquid-crystal inversion frequency (time frequency) of a waveform of a voltage supplied to the pixel electrode 62 depending on the drive mode. FIG. 19 is a graph of a waveform of a voltage supplied to the MIP. In FIG. 19, the drive mode is the first mode and is switched from the first mode to the second mode at time $t_1$. Subsequently, the drive mode is switched from the second mode to the first mode at time $t_2$.

The controller 42 drives VCOM, FRP, and XFRP at square-wave pulses of the first frequency during a period 80. FRP and XFRP are opposite to each other in phase as described above. The first frequency is 0.5 Hz, for example. In the first mode, the controller 42 turns OFF the backlight unit (BACK LIGHT in FIG. 19) 31.

The controller 42 detects information serving as a trigger for shifting to the second mode at time $t_1$ with the state detecting unit 44. Information of an operation input through an operating unit corresponding to the display device 1 is detected as the information serving as a trigger, for example. Specifically, pressing of a button is detected as the information. In the case where the display device 1 is a touch panel, a touch may be detected as the information via a touch sensor. The illuminance of external light may be detected as the information via an external-light sensor. When the state detecting unit 44 detects an operation, the controller 42 shifts to the second mode. The controller 42 drives VCOM, FRP, and XFRP at square-wave pulses of the second frequency during a period 82 in the second mode. FRP and XFRP are opposite to each other in phase as described above. The second frequency is 60 Hz, for example. In the second mode, the controller 42 turns ON the backlight unit (BACK LIGHT in FIG. 19) 31. Thus, the display device 1 causes light output from the backlight unit 31 to pass through the lower substrate 10, the liquid crystal layer 30, and the upper substrate 20 and to be output as video light. The display device 1 sets the liquid-crystal inversion frequency to 60 Hz during the period 82.

The controller 42 detects information serving as a trigger for shifting to the first mode at time $t_2$ with the state detecting unit 44. When a certain period of time has elapsed since time $t_1$, for example, the state detecting unit 44 determines that the information serving as a trigger for shifting to the first mode is detected. In this case, the state detecting unit 44 may make the determination on condition that no operation is detected during the certain period of time. The state detecting unit 44 may make the determination on condition that the external-light sensor detects the illuminance of external light. In the same manner as in the period 80, the controller 42 controls the display device 1 in the first mode during a period 84 after time $t_2$.

Figure 20:
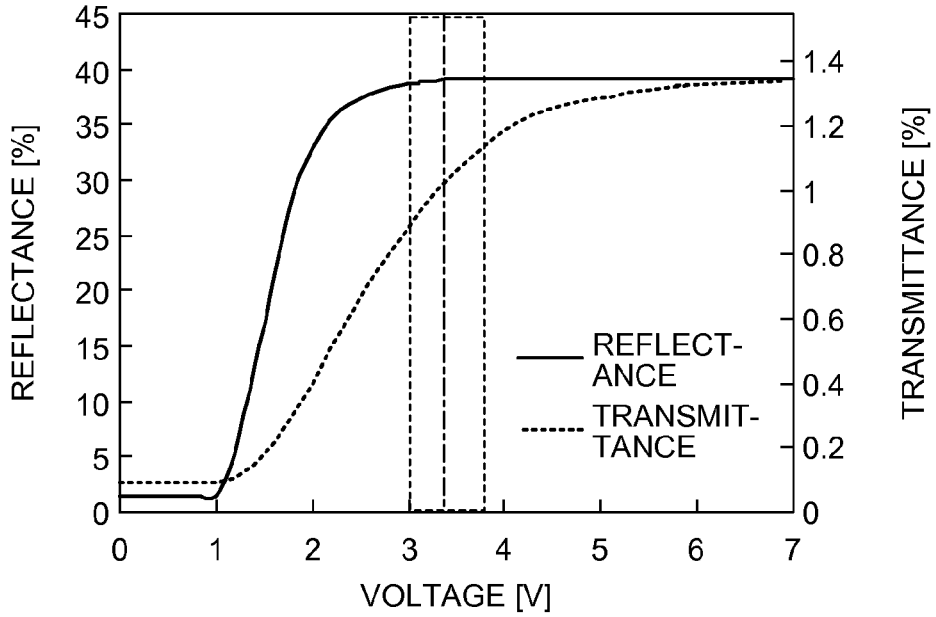
FIG. 20 is a graph of a relation among the voltage, the transmittance, and the reflectance of the display device illustrated in FIG. 2.
Figure 21:
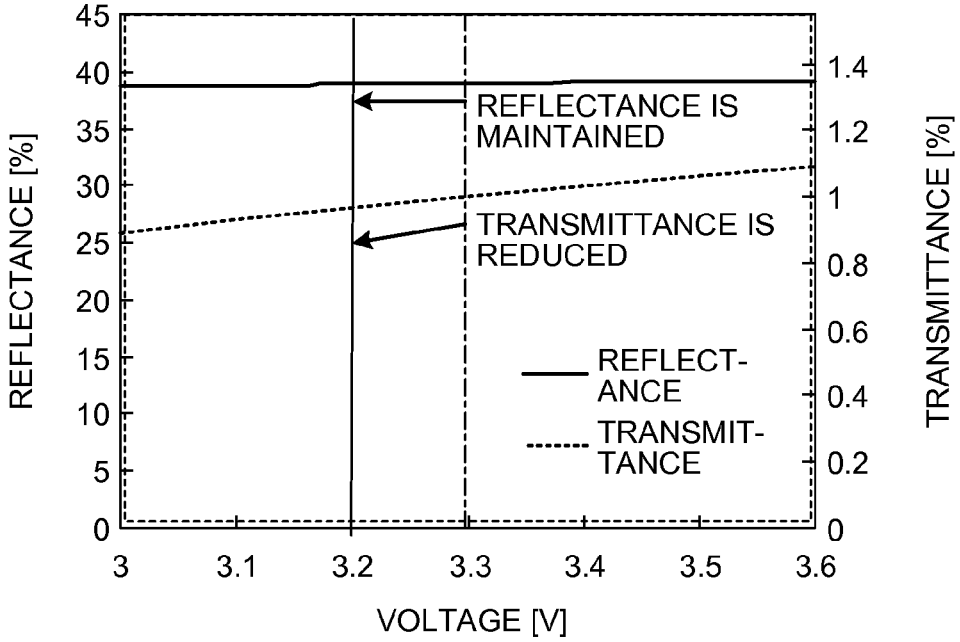
FIG. 21 is a partially enlarged view of FIG. 20.

FIG. 20 is a graph of a relation among the voltage, the transmittance, and the reflectance of the display device illustrated in FIG. 2. FIG. 21 is a partially enlarged view of FIG. 20. FIG. 20 and FIG. 21 illustrate a voltage transmittance (VT) curve and a voltage reflectance (VR) curve. As illustrated in FIG. 20 and FIG. 21, in the display device 1, when a voltage of a pixel (drive voltage) is determined such that the phase difference is reduced with respect to reflection, a range in which the transmittance changes is obtained. Specifically, when a drive voltage is determined as 3.3 V, fluctuations in the reflectance are reduced but fluctuations in the transmittance are increased as illustrated in FIG. 21. In other words, the VT curve is inclined. A higher voltage can maintain both the reflectance and the transmittance as illustrated in FIG. 20 and FIG. 21. An increase in the drive voltage, however, increases the power consumption.

In the second mode, the display device 1 according to the present embodiment sets the liquid-crystal inversion frequency to the second frequency higher than the first frequency in the first mode. The display device 1 sets the liquid-crystal inversion frequency to a higher frequency in the second mode in which a flicker is likely to occur, thereby reducing a flicker in the second mode. Regarding the first mode, the display device 1 employs the normally black display mode as described above, thereby reducing a flicker even with a low liquid-crystal inversion frequency in the first mode. The second frequency is preferably set to equal to or higher than the CFF. This makes it possible to reduce a flicker in the second mode. The CFF is a value varying depending on conditions, such as the screen luminance, as described above. The second frequency is preferably set to equal to or higher than 40 Hz. This makes it possible to reduce a flicker in the second mode.

As described above, when display is performed in the two modes, the display device 1 switches the liquid-crystal inversion frequencies of the respective modes, thereby reducing the power consumption and reducing a flicker. Because of the capability to display an image in the two modes, the display device 1 can change the mode for display depending on the intensity of ambient light. This enables the user to view an image in a dark place and to effectively use ambient light.

The display device 1 according to the present embodiment uses an opening in a reflective electrode, specifically, uses a space formed around a divided reflective electrode as an opening, thereby causing light to pass through the opening in the second mode (transmissive mode). This enables the display device 1 to display an image in the transmissive mode while maintaining the size of the reflective electrode. In other words, the use of the light passing through the opening in the second mode (transmissive mode) enables the display device 1 to use the liquid crystal of the same area as that in the first mode. As a result, it is possible to effectively use the area of a pixel and to increase the size of the reflective electrode. The use of the space formed around the divided reflective electrode as the opening enables the effective use of a space required to arrange the pixel of the reflective electrode. This can increase the area in which the reflective electrode reflects light in the first mode, thereby lowering the threshold of the intensity of ambient light to see an image. In other words, the user can see the image in a darker environment.

The display device 1 is optically designed so as to reduce the reflectance at an angle that makes a flicker conspicuous due to angular dependence of the liquid crystal as illustrated in FIG. 7B in the use of the display device 1 in reflection. Thus, the display device 1 can perform low-frequency driving that cannot be achieved in the transmissive mode (second mode). In other words, even if the liquid-crystal inversion frequency is set to a low frequency in the reflective mode (first mode), the display device 1 can reduce a flicker. In the second mode, the display device 1 sets the liquid-crystal inversion frequency to a high frequency, thereby suitably reducing a flicker even with liquid crystal adjusted for the reflective mode, for example.

The display device 1 preferably uses the same voltage for the voltage applied to the pixel electrode in the two modes. This can simplify the circuit configuration. In addition, there is no need to use a transistor having unnecessarily high voltage resistance, for example. Even if the display device 1 uses the same voltage for the voltage applied to the pixel electrode in the two modes, the display device 1 switches the liquid-crystal inversion frequency, thereby reducing a flicker.

Figure 22:
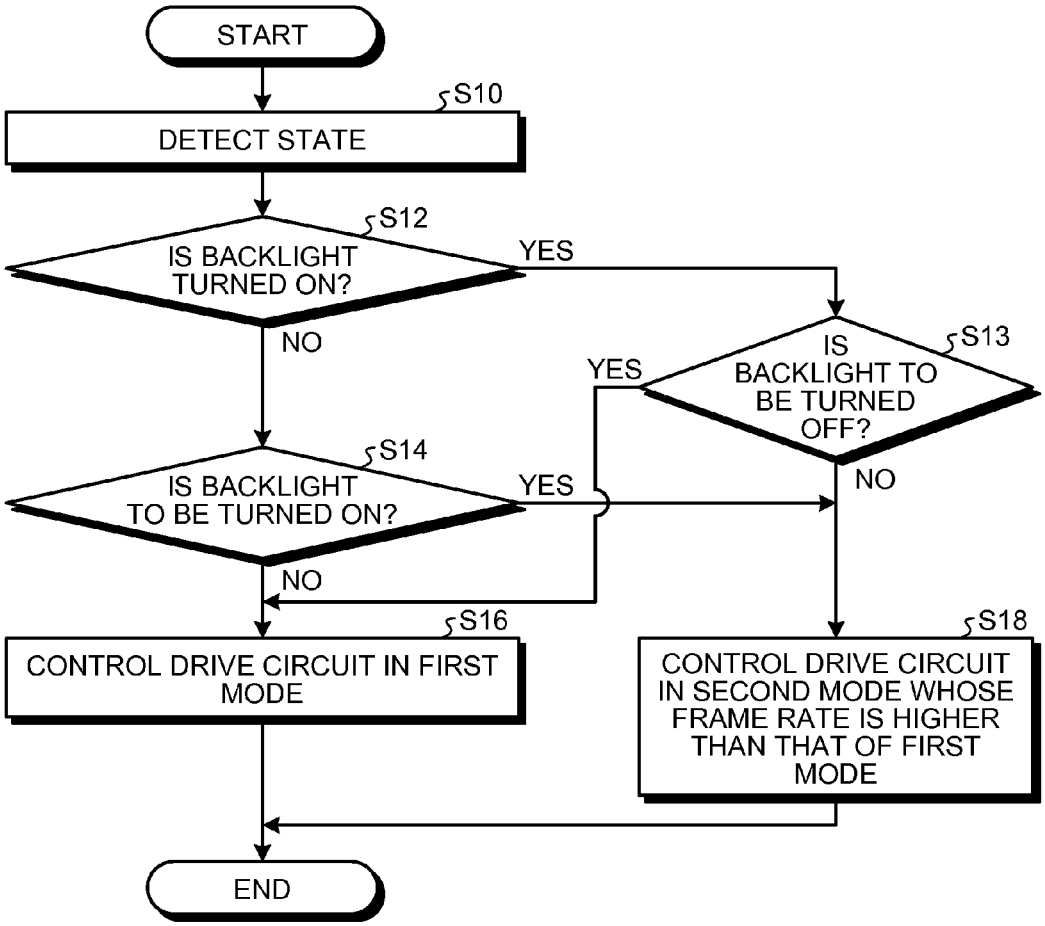
FIG. 22 is a flowchart of an example of an operation performed by the display device illustrated in FIG. 2.

FIG. 22 is a flowchart of an example of an operation performed by the display device illustrated in FIG. 2. The display device 1 controls an operation of each unit based on the information acquired by the controller 42 from each unit, mainly on the information detected by the state detecting unit 44, thereby performing the operation. FIG. 22 illustrates control for determining the mode based on turning ON or OFF of the backlight (backlight unit 31). When the back light is turned OFF, the first mode is performed; whereas when the back light is turned ON, the second mode is performed in FIG. 22.

The controller 42 detects the state at Step S10. Specifically, the controller 42 acquires results of detection performed by the state detecting unit 44. The controller 42 may acquire information of control being performed (whether the backlight is turned ON). After detecting the state at Step S10, the controller 42 determines whether it is in a state where the backlight is turned ON at Step S12. In other words, the controller 42 determines whether the backlight unit 31 is turned ON. When it is determined that the backlight is turned ON at Step S12 (Yes at Step S12), the controller 42 determines whether to turn OFF the backlight at Step S13. In other words, the controller 42 determines whether a state where the backlight unit 31 is turned ON and information of a trigger for turning OFF the backlight unit 31 are detected. When determining to turn OFF the backlight at Step S13 (Yes at Step S13), the controller 42 goes to Step S16. When determining not to turn OFF the backlight at Step S13 (No at Step S 13), that is, when determining to maintain the ON-state, the controller 42 goes to Step S18.

When determining that the backlight is not turned ON at Step S12 (No at Step S12), the controller 42 determines whether to turn ON the backlight at Step S14. In other words, the controller 42 determines whether a state where the backlight unit 31 is turned OFF and information of a trigger for turning ON the backlight unit 31 are detected. When determining to turn ON the backlight at Step S14 (Yes at Step S14), the controller 42 goes to Step S18.

When determining not to turn ON the backlight at Step S14 (No at Step S14), that is, when determining to maintain the OFF-state, the controller 42 goes to Step S16. When it is determined to be Yes at Step S13 or when it is determined to be No at Step S14, the controller 42 controls the drive circuit 40 in the first mode at Step S16. In other words, the controller 42 sets the liquid-crystal inversion frequency to the first frequency to perform control. The processing is then terminated.

When it is determined to be No at Step S12 or when it is determined to be Yes at Step S14, the controller 42 controls the drive circuit 40 in the second mode whose liquid-crystal inversion frequency is higher than that of the first mode, at Step S18. In other words, the controller 42 sets the liquid-crystal inversion frequency to the second frequency higher than the first frequency to perform control. The processing is then terminated.

The display device 1 repeatedly performs the processing described above, thereby providing the liquid-crystal inversion frequency corresponding to the mode for displaying an image. Thus, the display device 1 can reduce a flicker in the respective modes. The information detected by the state detecting unit 44, that is, the trigger for switching the modes is not limited to turning ON or OFF of the backlight and may be various types of information. A dark environment with an amount of ambient light of equal to or smaller than a predetermined value, for example, may be used as a trigger for shifting to the second mode.

1-3. Modification

Figure 23:
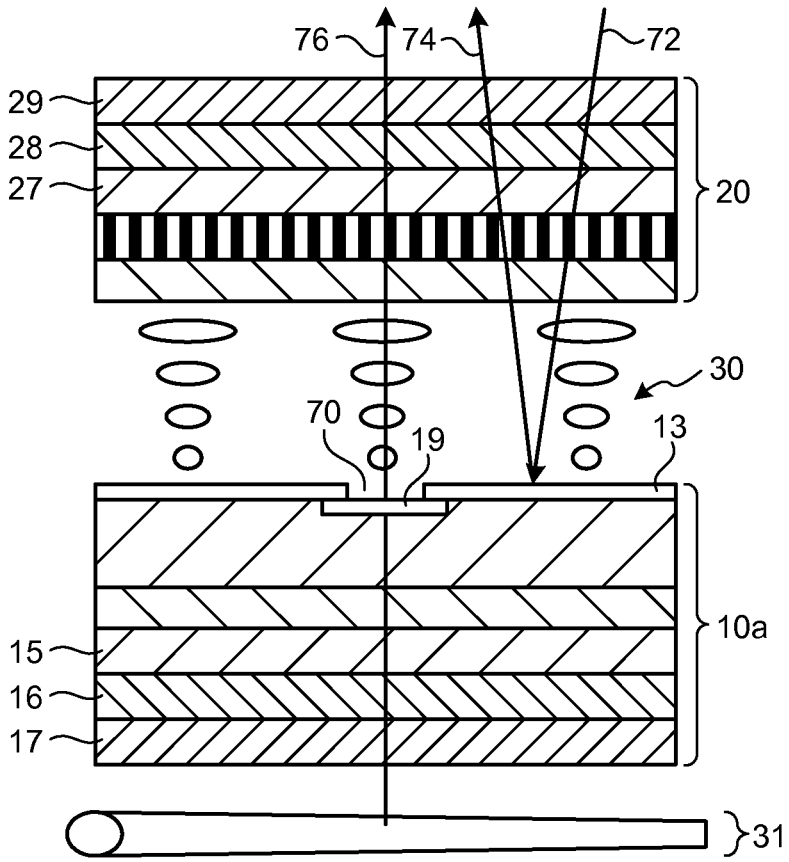
FIG. 23 is a view for explaining another example of the display device.

FIG. 23 is a view for explaining another example of the display device. A display device illustrated in FIG. 23 has the same configuration as that of the display device 1 except for arrangement of a transmissive electrode 19 in a lower substrate 10*a* and the position at which an opening 70 is formed. The opening 70 is formed at the center of the pixel electrode 62. The openings 68 and 69 are formed around the pixel electrode 62. While the opening 70 is formed at the center of the pixel electrode 62, difference in level is not large. This configuration can decrease influence of reduction in size of the reflective electrode of the pixel electrode 62 compared with the case where difference in level is made. This enables the user to see an image in the first mode in a dark environment.

The transmissive electrode 19 is arranged at the opening 70. The transmissive electrode 19 is made of a transparent material that transmits light, such as an ITO (a transparent conductive film or an indium tin oxide (a tin-doped indium oxide)). The transmissive electrode 19 is arranged at a portion with no electrode provided in the reflective electrode layer 13, that is, at the opening 70, thereby stabilizing the electric field on the surface of the reflective electrode layer 13. This makes it possible to control alignment of areas corresponding to respective pixels in the liquid crystal layer 30 with higher accuracy. The arrangement of the transmissive electrode 19 can stabilize the electric field of an area in which the opening 70 is formed.

The display device 1 according to the embodiment has the backlight unit 31 arranged on the side of the lower substrate 10 opposite to the liquid crystal layer 30 so as to cause light output from the backlight unit 31 to enter the lower substrate 10. The configuration is not limited thereto. The display device 1 may use ambient light entering the lower substrate 10 as the light entering the lower substrate 10, that is, the light used in the second mode (transmissive display mode). In this case, the display device 1 is formed of a transparent housing, for example, so as to allow the ambient light to enter from the surface on the side of the lower electrode 10 opposite to the liquid crystal layer 30. As described above, the display device 1 can display an image in the two modes with no light source. Because the display device 1 is not provided with the backlight unit 31 in this case, it is possible to simplify the device configuration and reduce energy consumption due to emission of light.

2. Example of Application

Figure 24:
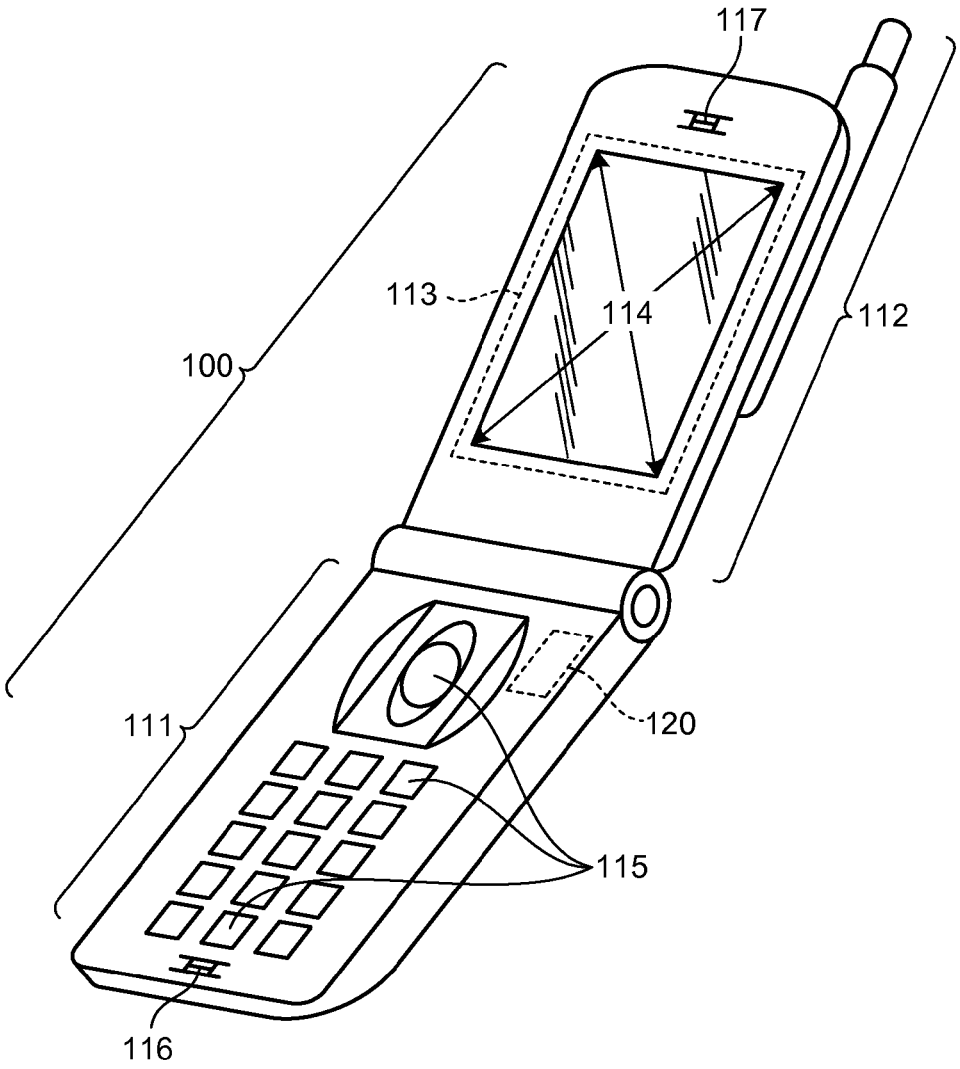
FIG. 24 is a perspective view of an example of a configuration of an electronic apparatus according to an embodiment.

The following describes an example of application of the display device 1 according to the embodiment and the modification thereof. FIG. 24 is a perspective view of an example of a schematic configuration of an electronic apparatus 100 according to the example of application. The electronic apparatus 100 is a mobile phone. As illustrated in FIG. 24, the electronic apparatus 100 includes a main body 111 and a display body 112 provided in an openable and closable manner with respect to the main body 111, for example. The main body 111 includes operation buttons 115 and a mouthpiece 116. The electronic apparatus 100 also includes a control device 120 that integrally controls the electronic apparatus 100. The display body 112 includes a display device 113 and an earpiece 117. The display device 113 displays various types of display related to telephone communications on a display screen 114 of the display device 113. The electronic apparatus 100 includes a controller that controls an operation of the display device 113. The controller is provided in the main body 111 or the display body 112 as a part of the control device 120 or separately from the control device 120. The control device 120 that integrally controls the electronic apparatus 100 supplies a video signal to the controller of the display device 113. Specifically, the control device 120 determines an image to be displayed on the electronic apparatus 100 and transmits a video signal of the image thus determined to the controller of the display device 113. Thus, the control device 120 causes the display device 113 to display the image thus determined.

The display device 113 has the same configuration as that of the display device 1 according to the embodiment or the modification thereof. This enables the display device 113 to reduce the power consumption while reducing a flicker.

Examples of the electronic apparatus to which the display device 1 according to the embodiment and the modification thereof is applicable include, but are not limited to, a clock with a display device, a watch with a display device, a personal computer, a liquid crystal television, a video camera recorder with a viewfinder or a direct-view monitor, a car navigation system, a pager, an electronic organizer, a calculator, a word processor, a workstation, a video phone, a point-of-sale (POS) terminal, etc. besides the mobile phone described above.

As described above, according to an aspect of the present disclosure, a display device and an electronic apparatus each include a liquid crystal layer, a transparent electrode, and a reflective electrode. The transparent electrode is arranged on a side of the liquid crystal layer on which ambient light is incident. The reflective electrode is arranged on a side of the liquid crystal layer opposite to the transparent electrode and reflects light reaching from the liquid crystal layer. The reflective electrode is divided into pixel electrodes. A pixel is formed of the pixel electrode, the transparent electrode, and the liquid crystal layer interposed therebetween. An opening is formed around the pixel electrode in the reflective electrode. The opening and the reflective electrode are formed in a manner less likely to have difference in level, thereby preventing reduction in the area of the reflective electrode. The display device and the electronic apparatus each include a drive circuit and a controller. The drive circuit controls a voltage applied to the pixel electrode and the transparent electrode to control a voltage applied to the liquid crystal layer of each pixel, thereby driving each pixel. The controller controls an operation of the drive circuit. Each pixel displays black when the same potential is applied between the reflective electrode and the transparent electrode (when no voltage generating a potential difference is applied between the reflective electrode (that is, the pixel electrode) and the transparent electrode, that is, when the same potential is applied thereto) and displays white when a predetermined voltage difference is applied between the reflective electrode and the transparent electrode. The drive circuit performs switching in accordance with a video signal such that a voltage for displaying black or white is applied to each pixel.

According to an aspect of the present disclosure, the display device and the electronic apparatus display an image by area coverage modulation and in a normally black mode. The area coverage modulation means black-and-white binary gradation performed without halftone gradation. The normally black mode provides stable luminance even if a voltage applied to the liquid crystal in white display is reduced to some extent during a frame period. Thus, even if the voltage applied to the liquid crystal layer of each pixel is reduced to some extent during a frame period in frame inversion driving, 1H inversion driving, 1V inversion driving, or dot inversion, for example, it is possible to provide stable luminance. Such stable luminance can reduce a flicker even if the drive frequency is set to a low frequency to display an image in a first mode (reflective display).

When an emphasis is placed on the aperture ratio in the reflective display area, and the thickness of the liquid crystal layer for transmission is not optimized, a voltage for displaying white in transmission may set to a portion inclined in a VT curve (refer to FIG. 20). Thus, a little fluctuation in the voltage for displaying white may cause a flicker to be detected.

To address the problem described above, according to an aspect of the present disclosure, the controller switches a mode between a first mode and a second mode. The first mode is a mode for driving the drive circuit at a liquid-crystal inversion frequency of a first frequency to perform screen display using light reflected by the reflective electrode. The second mode is a mode for driving the drive circuit at a liquid-crystal inversion frequency of a second frequency higher than the first frequency to perform screen display using light passing through the opening of the reflective electrode.

According to an aspect of the present disclosure, the display device and the electronic apparatus can perform display on the screen in the first mode and the second mode at liquid-crystal inversion frequencies corresponding to the respective modes. The first mode is a mode for performing screen display using light reflected by the reflective electrode. The second mode is a mode for performing screen display using light reflected by the reflective electrode and light passing through the opening of the reflective electrode. Adjustment of the liquid-crystal inversion frequency in this manner makes it possible to perform control correspondingly to the respective modes, thereby reducing a flicker. The display device and the electronic apparatus set the liquid-crystal inversion frequency used to display an image in the second mode (transmissive display) in which low-frequency driving is less likely to reduce a flicker higher than that of the first mode. This makes it possible to suitably reduce a flicker occurring when an image is displayed using light passing through the opening of the reflective electrode.

According to an aspect of the present disclosure, a display device and an electronic apparatus switch the liquid-crystal inversion frequency between a first mode for displaying an image using ambient light reflected by a reflective electrode and a second mode for displaying an image using light reflected by the reflective electrode and light passing through the reflective electrode. In addition, the display device and the electronic apparatus display an image by the area coverage modulation and in the normally black mode, thereby reducing a flicker. The display device and the electronic apparatus do not deteriorate the reflective characteristics. Thus, the display device and the electronic apparatus can display an image in the first mode performed without a backlight in most environments. As a result, the display device and the electronic apparatus can set the liquid-crystal inversion frequency lower, thereby reducing the power consumption. To display an image in the second mode performed with a backlight, the display device and the electronic apparatus set the liquid-crystal inversion frequency higher, thereby reducing a flicker. Thus, it is possible to reduce a flicker, reduce the power consumption, and ensure the visibility in a dark place.

It should be understood that various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention is claimed as follows:

1. A display device comprising:

a liquid crystal layer;

a transparent electrode arranged on a side of the liquid crystal layer on which ambient light is incident;

a reflective electrode arranged on a side of the liquid crystal layer opposite to the transparent electrode and reflecting light reaching from the liquid crystal layer, the reflective electrode being divided into a plurality of pixel electrodes formed for each pixel, each pixel being formed of one of the pixel electrodes, the transparent electrode, and the liquid crystal layer interposed therebetween, the reflective electrode having a plurality of openings formed around the respective pixel electrodes;

a drive circuit for controlling a voltage applied to the pixel electrode and the transparent electrode to drive each pixel; and a controller for controlling an operation of the drive circuit, wherein the pixel is configured to display black when a same potential is applied between the pixel electrode and the transparent electrode and display white when a predetermined voltage difference is applied between the pixel electrode and the transparent electrode, the drive circuit is configured to perform switching in accordance with a video signal such that a voltage for displaying white or black is applied between the pixel electrode and the transparent electrode, and the controller is configured to switch a mode between a first mode for driving the drive circuit at a liquid-crystal inversion frequency of a first frequency so that screen display using light reflected by the reflective electrode is performed and a second mode for driving the drive circuit at a liquid-crystal inversion frequency of a second frequency higher than the first frequency so that screen display using light passing through the opening of the reflective electrode is performed.

2. The display device according to claim 1, wherein the pixel electrode includes a plurality of partial electrodes, and the drive circuit drives the partial electrodes independently based on the video signal.

3. The display device according to claim 1, wherein the second frequency is a frequency equal to or higher than a critical flicker frequency.

4. The display device according to claim 1, wherein the second frequency is equal to or higher than 20 Hz.

5. The display device according to claim 1, wherein the first frequency is equal to or lower than 30 Hz.

6. The display device according to claim 5, wherein the first frequency is equal to or higher than 0.05 Hz.

7. The display device according to claim 1, further comprising a backlight unit arranged on a side of the reflective electrode opposite to the liquid crystal layer, wherein the controller turns ON or OFF the backlight unit.

8. The display device according to claim 7, wherein the controller drives the drive circuit in the first mode when the backlight is turned OFF and drives the drive circuit in the second mode when the backlight is turned ON.

9. The display device according to claim 1, wherein the opening is formed between the adjacent reflective electrodes.

10. The display device according to claim 1, wherein each pixel includes a memory circuit.

11. The display device according to claim 1, further comprising:

a phase difference layer arranged closer to a side on which the ambient light is incident than the liquid crystal layer; and a polarizing plate arranged closer to the side on which the ambient light is incident than the liquid crystal layer.

12. The display device according to claim 11, further comprising an anisotropic scattering layer arranged closer to the side on which the ambient light is incident than the liquid crystal layer, wherein a scattering central axis of the anisotropic scattering layer coincides with a main visual angle direction.

13. The display device according to claim 12, wherein the liquid crystal layer, the phase difference layer, and the polarizing plate are configured such that, when no anisotropic scattering layer is provided, a direction in which a flicker is made most conspicuous is different from the main visual angle direction.

14. The display device according to claim 1, wherein the transparent electrode is connected to a transparent electrode of a pixel adjacent thereto, and the drive circuit changes a voltage applied to the reflective electrode to drive each pixel of the liquid crystal display panel.

15. The display device according to claim 1, wherein at least a part of the reflective electrode is connected to a reflective electrode of a pixel adjacent thereto, and the drive circuit changes a voltage applied to the transparent electrode to drive each pixel of the liquid crystal display panel.

16. An electronic apparatus comprising:

the display device according to claim 1; and a control device that supplies the video signal to the display device.

* * * * *